US009896808B2

(12) United States Patent
Hassan

(10) Patent No.: US 9,896,808 B2
(45) Date of Patent: Feb. 20, 2018

(54) SAFETY SURFACE WITH ENGINEERED SHOCK-ABSORBING BASE

(71) Applicant: PLAYSAFER SURFACING, LLC, a division of RUBBERECYCLE, Lakewood, NJ (US)

(72) Inventor: Morris Hassan, Lakewood, NJ (US)

(73) Assignee: Playsafer Surfacing LLC a division of Rubberecycle, Lakewood, NJ (US)

( * ) Notice: Subject to any disclaimer, the term of this patent is extended or adjusted under 35 U.S.C. 154(b) by 0 days.

(21) Appl. No.: 15/292,315

(22) Filed: Oct. 13, 2016

(65) Prior Publication Data

US 2017/0226707 A1 Aug. 10, 2017

Related U.S. Application Data

(60) Provisional application No. 62/291,627, filed on Feb. 5, 2016.

(51) Int. Cl.
*E01C 13/02* (2006.01)
*E01C 13/06* (2006.01)
(Continued)

(52) U.S. Cl.
CPC ..... *E01C 13/065* (2013.01); *A63C 19/04* (2013.01); *E01C 3/006* (2013.01); *E01C 5/223* (2013.01);
(Continued)

(58) Field of Classification Search
CPC ..... E01C 9/00; E01C 11/00; E01C 11/225; E01C 11/22; E01C 13/00; E01C 13/02;
(Continued)

(56) References Cited

U.S. PATENT DOCUMENTS 6,777,062 B2 * 8/2004 Skaja ..... B32B 3/26 428/143
8,221,856 B2 * 7/2012 Stroppiana ..... A47G 27/0468 428/17
2009/0031658 A1 2/2009 Moller, Jr. et al.

FOREIGN PATENT DOCUMENTS

EP 2821550 1/2015
WO WO2014106146 7/2014

OTHER PUBLICATIONS

Extended European Search Report in Application No. 17154641.9, dated Jun. 21, 2017.

* cited by examiner

*Primary Examiner* — Kien Nguyen
(74) *Attorney, Agent, or Firm* — Weiss & Arons LLP

(57) ABSTRACT

A safety surface with an engineered shock-absorbing base. The base may include one or more engineered resilient mats. The mats may be fabricated of repurposed tire rubber. The mats may be adjoined edgewise. Adjoined mats may be coupled together. The base may overlay a surface. The base may include upward-facing pockets. Interiors of the pockets may receive loose fill. An upper layer may cover the base. The upper layer may bond to the base. The upper layer may seal the loose fill within the safety surface. The upper layer may include poured-in-place surfacing. The upper layer may be textured. The upper layer may include synthetic turf. Impact upon the upper layer may be attenuated by flexion of the base. Mats may be coupled without hardware fasteners. Exterior surfaces of pockets of one mat may be nested into complementarily contoured features of an adjoining mat.

41 Claims, 13 Drawing Sheets

(51) Int. Cl.

| | |
|---|---|
| ***A63C 19/04*** | (2006.01) |
| ***E01C 5/22*** | (2006.01) |
| ***E01C 9/00*** | (2006.01) |
| ***E01C 13/04*** | (2006.01) |
| ***E01C 19/52*** | (2006.01) |
| ***E01C 3/00*** | (2006.01) |
| *A63C 13/00* | (2006.01) |

(52) U.S. Cl.
CPC ..... *E01C 5/226* (2013.01); *E01C 9/001* (2013.01); *E01C 13/045* (2013.01); *E01C 13/06* (2013.01); *E01C 19/52* (2013.01)

(58) Field of Classification Search
CPC ..... E01C 13/045; E01C 13/065; A47G 27/00; A47G 27/0468; B32B 3/00; B32B 3/26; A63C 19/00; A63C 19/04
USPC ..... 472/88–92; 428/17, 21
See application file for complete search history.

SAFETY SURFACE WITH ENGINEERED SHOCK-ABSORBING BASE

CROSS-REFERENCE TO OTHER APPLICATIONS

This application is a nonprovisional of U.S. application Ser. No. 62/291,627, which was filed on Feb. 5, 2016, and is hereby incorporated by reference herein in its entirety.

FIELD OF TECHNOLOGY

Aspects of the disclosure relate to safety surfaces. More particularly, the disclosure relates to safety surfaces for use in playgrounds, or in other suitable areas such as indoor or outdoor recreational spaces. Such areas may include rock climbing training centers, areas surrounding trampolines, gymnasium floors, sports fields or other areas that may require impact attenuation.

BACKGROUND OF THE INVENTION

According to Centers for Disease Control and Prevention ("CDCP") statistics, traumatic brain injury is a major cause of death and disability, accounting in the United States for about 30% of all injury deaths. Those who survive traumatic brain injury may suffer long-lasting disabilities, some lasting the rest of their lives. CDCP data indicate that the rate of hospital emergency department visits for sports and recreation-related injuries with a diagnosis of concussion or traumatic brain injury rose 57%, from 2001 to 2009, for the age bracket of 19 years or younger. From 2006 to 2010, over 40% of traumatic brain injuries were caused by falls, with the percentage for age bracket 0-14 years being 55%. In 2013, for each age bracket reported by the CDCP (from under one year of age to 65+ years), unintentional falls ranks, out of 10 leading causes, as the first or second cause of nonfatal injuries treated in hospital emergency departments.

All ages suffer from the trauma of falls, with a disproportionate share borne by those in age brackets 1-4, 15-24, 25-34, 35-44, 45-54, 55-64 and 65+, with the latter accounting for almost three times the fall-related injuries of the highest of the other brackets. (The large age range of the 65+ bracket and the increasing frailty and likelihood of falling of those in that age bracket, may account for their statistics.) According to CDCP statistics, each year, in the United States alone, over 200,000 playground injuries result in children's emergency department visits, with over three-quarters of those injuries being from falls. Approximately half of all playground injuries may be severe, involving fractures, internal injuries, concussions, dislocations and/or amputations. For young adults, recreational areas and even semi-professional and professional sports areas may be likely sites of severe fall injuries.

To protect children from fall injuries, play areas have been required to be provided with safety surfaces. A safety surface may be required to underlie and/or cover a play area on which children may fall. The area may typically be associated with playground equipment, such as "jungle gyms," swings and horizontal ladders, or with gymnasium equipment, such as parallel bars, gymnastic rings and climbing ropes. A fall from such playground equipment or gymnasium equipment can be from an elevation several times a child's height. The safety surface is intended to cushion the fall by attenuating impact forces associated with the fall.

Safety surfaces may also be mandated by requirement, or recommended as "best practice," for other play areas and recreational areas as well, such as in zones along paths and adjacent to "whirls"/"roundabouts" and rock climbing walls.

Similarly, safety surfaces may be recommended to protect children and young adults in sports areas.

The Americans with Disabilities Act (ADA) requires that all public playgrounds be accessible to disabled people. ADA standards require a unitary (continuous or with minimal gaps) safety surface such as poured-in-place rubber or edge-joined rubber tiles, so as to provide wheelchair accessibility. These surfaces can be relatively hard and do not provide much cushion to protect children from falls. Safety surfaces are often poured or placed directly upon under-layer surfaces of concrete or crushed stone, further diminishing cushioning.

An additional deficiency in current technologies is inconsistency of performance. Deficient performance may be common over the area of a given installation; from installation to installation; and over time. Current safety surfaces may vary in shock absorbing properties at a given installation due to inconsistencies such as: variations in thickness of a poured-in-place surface, worsened by uneven under-layers; variations during installation in composition of the materials being poured or in the quality of tiles being placed upon the site; and differences in number of layers, or in composition and/or amount of binder between layers, of tiles being placed. Differences in ambient temperature and/or humidity during an installation or between installations may contribute to variations in shock absorbing properties of installed surfaces. Hardening over time of binder between layers can contribute to progressive degradation of shock absorbing performance.

Safety surfaces of loose fill material such as shredded rubber or crumb rubber material may provide high cushioning. In addition, such materials may be environmentally friendly "green" materials, made from repurposed used automobile tires. However, safety surfaces of loose fill material provide relatively poor wheelchair accessibility.

ADA standards may proscribe the use of loose fill materials as currently practiced on playgrounds because of loose fill materials' typically low accessibility ratings. However, implementation of ADA standards with current unitary safety surfacing technologies may result in more playground injuries, particularly severe injuries, with the outcome that ADA compliant playgrounds may sacrifice safety for accessibility.

It would be desirable, therefore, to provide apparatus and methods for making recreational, sports and related areas safer from consequences of falls.

It would also be desirable, therefore, to provide apparatus and methods that provide consistently high shock-absorbing performance across the area of an installation; from installation to installation; and over time.

It would also be desirable, therefore, to provide apparatus and methods for making playgrounds and related areas wheelchair accessible without sacrificing safety.

SUMMARY OF THE DISCLOSURE

It is an object of this invention to provide apparatus and methods for making recreational, sports and related areas safer from consequences of falls.

It is an object of this invention to provide apparatus and methods that provide consistently high shock-absorbing performance across the area of an installation; from installation to installation; and over time.

It is an object of this invention to provide apparatus and methods for making playgrounds and related areas wheelchair accessible without sacrificing safety.

The apparatus of this invention may feature, and the methods of the invention may involve, one or more modular mats emplaced on-site upon an under-layer. (The terms "mat," "tile" and "mat/tile" may be used interchangeably herein.) The modular mats may include a rubber-like material. The material may be resilient.

The modular mats may readily be associated on-site. The modular mats may be associated edge-to-edge to cover an under-layer of greater area than a single modular mat. Associated modular mats may be mechanically fastened together. The fastening may use fastening hardware. The fastening hardware may include fastening tools. The fastening hardware may include rivets. The fastening hardware may include screws.

Associated modular mats may be mechanically coupled together. The coupling may be carried out without recourse to the fastening hardware. The fastening hardware may be used to facilitate the coupling. The fastening hardware may be used to secure the coupling.

The modular mats may include features that facilitate coupling the mats together. Features facilitating coupling may include one or more receptacles configured to receive and/or hold similar or different features of associated mats. The receptacles may have geometries complementary to one or more than one portion of the mats. The receptacles may be integral to one or more than one edge of the mats.

The modular mat(s) may be trimmed to conform to the area of an under-layer of configuration not matching an integral number of modular mat(s). The modular mat(s) may be of a variety of shapes, such as square, rectangular, triangular, or any other suitable shape. Any other suitable shape may include circular or elliptical. The modular mat(s) may be of a range of sizes. For example, for square mats, the "footprint" size may be 30" by 30", 36" by 36" or any other suitable size. Any other suitable size may include 48" by 48".

The modular mat(s) may serve as an engineered, shock-absorbing surface overlying the under-layer. As engineered products molded under factory conditions, the mats may provide consistent shock-absorbing performance. The mats may flex in response to impact. The mats may provide the shock-absorbing performance by flexing in response to impact. The flexing may absorb the impact energy. The flexing may attenuate the impact energy. The consistency of engineered, factory-molded mats as bases for safety surfaces may give a safety surface of the invention consistent shock-absorbing properties over the area of a site; from site to site; and over time.

The modular mat(s) may feature pockets with interiors open at an upper surface of the mat(s) and with exterior bottoms engaging the under-layer. The pocket interiors may be filled, partly or fully, with resilient loose fill material. The loose fill material may provide additional cushioning. The loose fill material may provide additional impact attenuation. The loose fill material may stabilize the pockets. The loose fill material may stabilize the pockets as the mats flex in response to impact. The loose fill material may include rubber.

An upper layer of resilient material may overlie the filled modular mat(s). One or more materials may be disposed between the modular mat(s) and the upper layer. One such material may include one, or more than one, adhesive. The adhesive(s) may bond the upper layer to the modular mat(s). The upper layer may be fixed to the modular mat(s) by the adhesive(s).

The upper layer may be fixed to the modular mat(s) by complementary geometries of an upper portion of the modular mat(s) and a lower portion of the upper layer. The upper layer may include projections that project into complementarily contoured regions of the modular mat(s). Abutment of the projections against the complementarily contoured regions may prevent shifting of the upper layer relative to the modular mat(s). Bonding of the projections to the complementarily contoured regions may prevent shifting of the upper layer relative to the modular mat(s). The adhesive(s) may contribute to the bonding.

One material between the modular mat(s) and the upper layer may be resilient material included in an auxiliary layer between the modular mat(s) and the upper layer. The auxiliary layer may be fixed relative to the modular mat(s) and the upper level. The auxiliary layer may be bonded to either or both of the upper level and the modular mat(s). The safety surface may include no, one or more than one auxiliary layer.

The upper layer may include a surface tiling. The upper layer may include a flooring surface. The upper layer may include synthetic turf. The upper layer may include a rolled-out surfacing-mat. The rolled-out surfacing-mat may include synthetic turf. The rolled-out surfacing-mat may include foam-backed turf. The upper layer may include a poured-in-place surface. The upper layer may include any suitable material(s). Any suitable material(s) may include rubber sheeting. Any suitable material(s) may include rubber sheets.

The poured-in-place surface may include a mixture of particles, pieces, crumbs, buffings nuggets and/or shreds of resilient material mixed with binder(s). The mixture may be laid out overlying the modular mat(s). The laid-out mixture may be leveled. The laid-out mixture may be smoothed. The laid-out mixture may be imprinted with a texture. The laid-out mixture may bear the texture. The laid-out mixture may be allowed to dry.

The upper layer and/or any auxiliary layers may hold the loose fill material within the pockets. The upper layer and/or any auxiliary layers may seal the loose fill material within the pockets. The modular mat(s), upper layer, loose fill material and any auxiliary layers, may provide enhanced impact attenuation to minimize serious injuries from falls.

The upper layer may provide a relatively smooth unitary surface. The smooth unitary surface, in conjunction with the modular mat(s), loose fill material and any auxiliary layers, may provide wheelchair accessibility, while enhancing safety.

BRIEF DESCRIPTION OF THE DRAWINGS

The objects and advantages of the invention will be apparent upon consideration of the following detailed description, taken in conjunction with the accompanying line drawings, in which like reference characters refer to like parts throughout, and in which.

DETAILED DESCRIPTION OF THE DISCLOSURE

Figure 1:
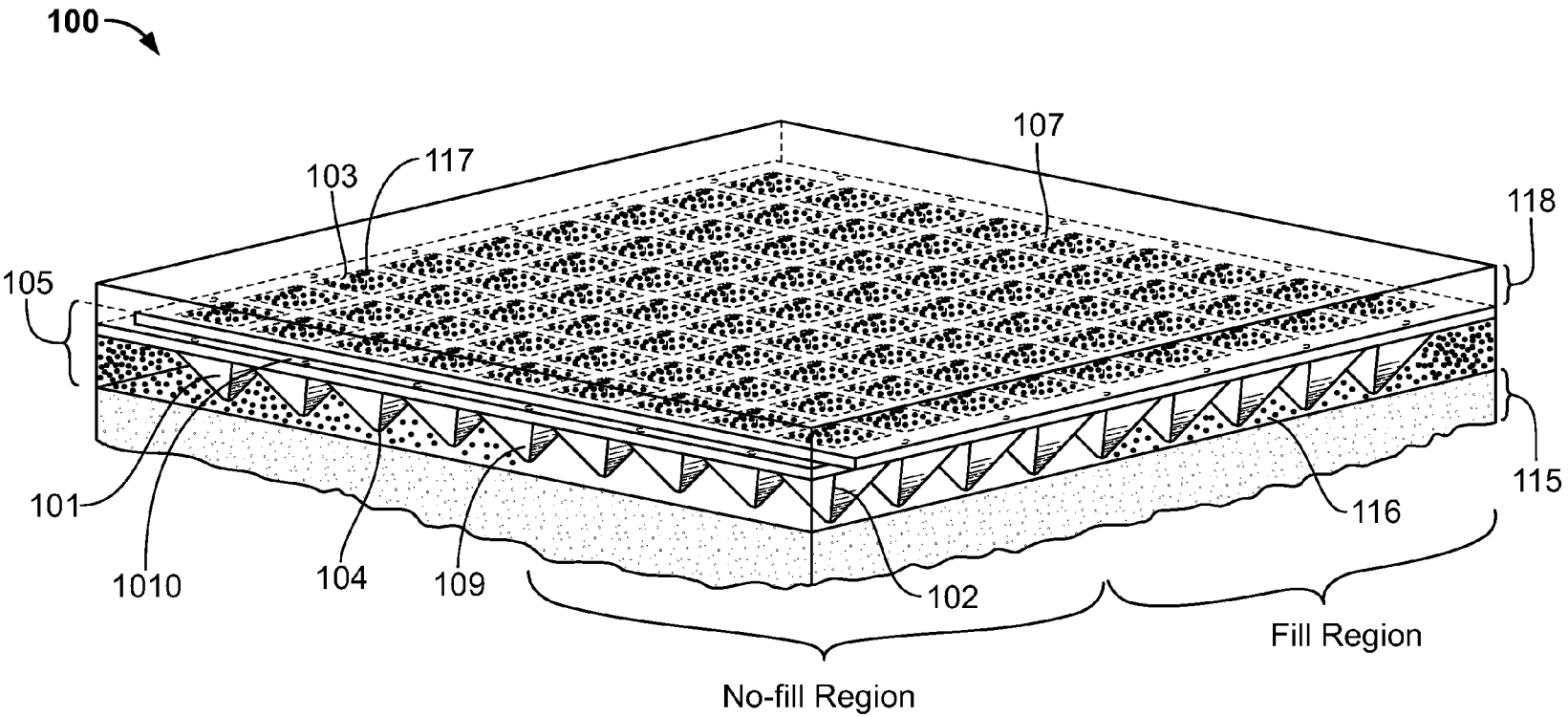
FIG. 1 is a perspective view of apparatus in accordance with principles of the invention.

Apparatus and methods for making playgrounds and related areas wheelchair accessible without sacrificing safety are provided. The apparatus may include, and the methods may involve, components and processes that make safe, accessible playgrounds and related areas cost effective to install and repair. Such cost effective installation may involve producing a new safe and accessible playground or recreational area. Such cost effective installation may involve retrofitting an existing playground or recreational area, converting it into a safe, accessible area.

The apparatus may include, and the methods may involve, mat/tiles (hereinafter, in the singular, a "mat/tile"). A mat/tile may be made from plastic, rubber or both. The rubber may be recycled rubber. The mat/tile may be made either exclusively from, or in combination with, any other suitable substance(s) added to or independent of the plastic and/or the rubber. Other suitable substance(s) may include readily biodegradable fibrous biomass, such as untreated wood fiber, and non-readily biodegradable fibers, such as nylon fiber.

Using recycled rubber, such as repurposed tire rubber, to produce the mat/tiles may be preferable because of easy access to supply as well as reduced production costs and high durability of the mat/tiles so produced. Using biodegradable biomass, such as repurposed saw mill waste and beer hops waste, to produce the mat/tiles may be preferable in situations where a playground may be intended to be abandoned after a relatively short period of use.

The mat/tile may include a thickness of the constituent substance(s). The mat/tile may include several thicknesses of substance(s), each thickness characterizing a different structural feature of the mat/tile. The thickness(es) may be between about ⅛" to about 1" or any other suitable thickness(es). Other suitable thickness(es) may be equal to or less than about ⅛". Other suitable thickness(es) may be equal to or more than about 1".

The mat/tile may be disposed on an under-layer. The under-layer may be level. The under-layer may provide drainage. The under-layer may include concrete. The under-layer may include crushed stone. The under-layer may include mineral aggregate. The under-layer may include packed earth. The under-layer may include any other suitable material.

The safety surface may include loose fill material (hereinafter, in the alternative, "loose fill"). The loose fill may include crumb rubber, wood mulch, or both. The loose fill may include exclusively, or in combination, any other suitable substance(s) added to or independent of the crumb rubber and/or the wood mulch. Other suitable substance(s) may include shredded rubber, rubber mulch, rubber buffings, rubber nuggets, wood fiber, pea gravel and sand. The loose fill may include recycled material. The recycled material may include recycled rubber from repurposed tires.

The mat/tile may be disposed directly on the under-layer. Loose fill may not be placed upon the under-layer. The safety surface may not include loose fill under the mat/tile.

The safety surface may include loose fill under the mat/tile. Loose fill may be placed upon the under-layer. Loose fill may be placed over a region of the under-layer. The region may be called a "fill region." The fill region may include some or all of the under-layer. The mat/tile may be placed upon the under-layer after the loose fill is placed over the fill region. A region of the under-layer not directly covered with loose fill may be called a "no-fill region." The no-fill region may include some or all of the under-layer.

The mat/tile may be overlain with loose fill. The loose fill overlying the mat/tile may be the same as the loose fill placed over the fill region. The loose fill overlying the mat/tile may be different, in whole or in part, from the loose fill placed over the fill region. The mat/tile, the loose fill overlying the mat/tile and any loose fill beneath the mat/tile, may be considered a mat/tile layer of the safety surface.

The mat/tile may include a plurality of empty pockets. A pocket may include an interior surface. The interior surface may be concave. Concavity of the interior surface may be defined relative to a top surface of the mat/tile, as viewed from above the mat/tile. The pocket may include a concave depression in the mat/tile.

The interior surface may receive part of the loose fill overlying the mat/tile. The loose fill overlying the mat/tile may be received from above the mat/tile. The loose fill overlying the mat/tile may cover none of, part of or all of the interior surface. The loose fill overlying the mat/tile may fill the pocket. The concavity may be of any shape suitable for receiving loose fill from above.

The pocket may include at least one pocket upper edge. The pocket upper edge may be part of a pocket rim. The pocket may be proximal to at least one other pocket. The pocket may be proximal to the at least one other pocket along the pocket upper edge. The pocket may be proximal to the at least one other pocket along at least part of the pocket rim.

The pocket upper edge may be part of a pocket upper perimeter. The pocket upper perimeter may be a perimeter of the pocket rim. The pocket upper perimeter may be an upper perimeter of the concave depression.

The loose fill overlying the mat/tile may cover none of, part of or all of the pocket rim. An upper surface of the loose fill received by the pocket may be below, about even with or above the pocket rim.

The pocket upper perimeter may include a perimeter shape. The perimeter shape may be polygonal, such as triangular, quadrilateral or any other suitable polygonal shape. Other suitable polygonal shapes may include pentagonal shapes and hexagonal shapes. Other suitable polygonal shapes may include star polygons.

The perimeter shape may be a curvilinear polygon, such as a trefoil, a quatrefoil or any other suitable curvilinear polygon shape. Other suitable curvilinear polygon shapes may include a cinquefoil. Other suitable curvilinear polygon shapes may include a hexafoil.

The perimeter shape may be a compound polygon, such as a triangle with two straights sides and a curved third side curving into an area between the two straight sides, a triangle with two straights sides and a curved third side curving away from the area between the two straight sides, or any other suitable compound polygon shape. Other suitable compound polygon shapes may include a shape with three sides of a trapezoid and a crescent-shaped fourth side.

The perimeter shape may be an ellipse, such as a circle, a golden ellipse or any other suitable ellipse. Other suitable ellipses may include a Steiner ellipse of a given triangle.

The perimeter shape may be any other suitable shape. Other suitable shapes may include an oval. Other suitable shapes may include a crescent.

The pocket may include an exterior surface. The exterior surface may be convex. The exterior surface may engage part of the loose fill placed upon the fill region. Engaging part of the loose fill placed upon the fill region by the exterior surface of the pocket may stabilize the loose fill placed upon the fill region. Stabilizing the loose fill placed upon the fill region may contribute to keeping the loose fill in place in the fill region.

The exterior surface may have surface features. The surface features may include the surface being smooth. The surface features may include the surface being rough. The surface features may include the surface being bumpy. The surface features may include the surface being stepped. The surface features may include the surface being ridged.

The exterior surface may be part of a geometric face. The geometric face may be continuous. The geometric face may be discontinuous. The geometric face may be interrupted. The geometric face may be interrupted by surface features of the exterior surface.

The geometric face may be part of an outer pocket shape. The exterior surface may be part of an outer pocket shape. The outer pocket shape may be part of a polyhedral shape, such as a pyramidal shape, a tetrahedral shape or any other suitable polyhedral shape. Other suitable polyhedral shapes may include a prism, such as a cuboid.

The outer pocket shape may be part of a curvilinear polyhedron, such as a curve-faced pyramid, a curve-faced tetrahedron or any other suitable curvilinear polyhedron shape. Other suitable polyhedral shapes may include a curve-faced prism, such as a curve-faced cuboid. One, or more than one, geometric face of the curvilinear polyhedron may be curved. Curvature of the curved face(s) may be concave. Curvature of the curved face(s) may be convex.

The outer pocket shape may be part of a compound polyhedron, such as a square pyramid of a pyramid-base-side of length s joined at its pyramid-base to a cube of edge-side of length s, or any other suitable compound polyhedron shape. Other suitable compound polyhedron shapes may include a tetrahedron joined at a tetrahedron-side to a triangular prism.

The outer pocket shape may be part of an ellipsoid, such as a sphere, a prolate ellipsoid, or any other suitable ellipsoid. Other suitable ellipsoids may include an oblate ellipsoid.

The outer pocket shape may be part of any other suitable shape. Other suitable shapes may include a cone. Other suitable shapes may include a frusto-conical shape. Other suitable shapes may include a cylinder. Other suitable shapes may include a cylinder capped by a cone. Other suitable shapes may include a cylinder capped by a hemisphere. Such suitable shapes may include any shape that is sufficient to engage the under-layer.

The pocket outer shape may include an extremity. A portion of the extremity may be at a maximal depth distance from the pocket upper edge. The extremity may be disposed at a deepest region of engagement of the pocket with the under-layer. Loose fill beneath the mat/tile may be adjacent the extremity. Loose fill beneath the mat/tile may surround the extremity. The extremity may contact the under-layer. The under-layer may include a ground surface beneath the mat/tile. The ground surface may underlie an outdoor play area. The extremity may contact a flooring surface beneath the mat/tile. The flooring surface may underlie an indoor play area. (The term "ground/flooring surface" may encompass both or either the ground surface and/or the flooring surface.) The ground/flooring surface may be the under-layer. The ground/flooring surface may underlie the under-layer.

A perimeter of the pocket outer shape proximal to the extremity may include a pocket lower perimeter. A pocket lower perimeter parallel to the pocket upper perimeter may be smaller than the pocket upper perimeter.

If an exemplary pocket has a pocket upper perimeter that is a circle of radius r and a pocket outer shape that is a right circular cone of a radius approximating r (approximately r plus a thickness of the substance(s) of the pocket) and with a cone-base parallel to, and continuous with, the substance(s) of the pocket upper perimeter, the exemplary pocket may appear, as viewed from above the mat/tile, as an empty conical concavity with a circular rim; the extremity of the exemplary pocket may include an apex of the cone. A perimeter of the right circular cone, taken perpendicular to an altitude of the cone, proximal to the apex may be smaller than the pocket upper perimeter.

The pocket may include one, or more than one, other extremity. Extremities of a mat/tile may have the same maximal depth. Extremities of a mat/tile may have different maximal depths. The plurality of pockets may include pockets of the same outer pocket shape. The plurality of pockets may include pockets of different outer pocket shapes.

The pocket may include an aperture. The aperture may interrupt at least part of the interior surface. The aperture may interrupt at least part of the exterior surface. The aperture may interrupt at least part of the geometric face. The aperture may interrupt at least part of the outer pocket shape. The aperture may lie proximal to the extremity.

The aperture may lie between the interior surface and the exterior surface. The aperture may extend between the interior surface and the exterior surface. The aperture may be a hole running through the substance(s) of the pocket. The hole may run straight. The hole may be circuitous.

The aperture may be microscopic. The aperture may be macroscopic. The aperture may be of any suitable size. The aperture may be sized to prevent passage of components of the loose fill through the aperture. The aperture may be sized to prevent entrance of components of the loose fill into the aperture.

The aperture may be of any suitable shape. A suitable aperture shape may be round. A suitable aperture shape may be square.

The aperture may allow passage of fluid through the pocket. The aperture may allow passage of fluid between the interior surface and the exterior surface. The aperture may allow passage of fluid from the interior surface to the under-layer. The aperture may allow passage of fluid from the interior surface to the ground/flooring surface. Passage of fluid may allow drainage of fluid from a top surface of the safety surface through the mat/tile layer to the under-layer.

The pocket may include another, or more than one other, aperture. The pocket may include multiple apertures of the same shape. The pocket may include multiple apertures of different shapes. The pocket may include multiple apertures of the same size. The pocket may include multiple apertures of different sizes. Aperture number, aperture shape and/or aperture size may be referred to collectively as aperture configuration.

The mat/tile may include another, or more than one other, pocket of the same aperture configuration. The mat/tile may include one, or more than one, pocket of a different aperture configuration. The mat/tile may include pockets of several different aperture configurations. The plurality of pockets may include pockets of the same aperture configuration. The plurality of pockets may include pockets of different aperture configurations.

In the exemplary pocket, above, of right circular conical outer pocket shape, the aperture may be a hole through the wall of the cone. The aperture may be proximal to the apex. The aperture may run through the apex. The aperture may truncate the apex. If the apex is truncated, the empty circular-rimmed right conical concavity of the exemplary pocket may be more accurately described as an empty circular-rimmed right frusto-conical concavity.

The mat/tile may include another, or more than one other, pocket of the same perimeter shape of the upper perimeter. The mat/tile may include one, or more than one, pocket of a different perimeter shape. The mat/tile may include pockets of several different perimeter shapes. The plurality of pockets may include pockets of the same pocket perimeter shape. The plurality of pockets may include pockets of different pocket perimeter shapes.

The mat/tile may include another, or more than one other, pocket of the same outer pocket shape. The mat/tile may include one, or more than one, pocket of a different outer pocket shape. The mat/tile may include pockets of several different outer pocket shapes. The plurality of pockets may include pockets of the same outer pocket shape. The plurality of pockets may include pockets of different outer pocket shapes.

The mat/tile may include a plurality of tile edges. The plurality of tile edges may be peripheral to an area of the mat/tile. The plurality of tile edges may surround the area of the mat/tile. The plurality of tile edges may define the area of the mat/tile. No tile edge, one tile edge or more than one tile edge of the mat/tile may include one or more than one structure configured to facilitate coupling the mat/tile to another mat/tile. The area of the mat/tile within the plurality of tile edges may include the plurality of pockets. The area of the mat/tile within the plurality of tile edges may include most of the "footprint" of the mat/tile on the under-layer.

The area of the mat/tile within the plurality of tile edges may include an area shape. The area shape may be any suitable shape, such as a polygon, a curvilinear polygon, a compound polygon, an ellipse and any other suitable shape. Other suitable shapes may include an oval. Other suitable shapes may include a crescent.

The plurality of tile edges may border the area shape. A tile edge may border at least part of the area shape. The tile edge may border at least part of the plurality of pockets. The tile edge may border at least part of a plurality of concave depressions of the mat/tile. The tile edge may border at least part of a plurality of rims of pockets. The tile edge may be integral to at least part of the plurality of rims of pockets. The tile edge may include the substance(s) of the rims. The tile edge may include one or more substances different from the substance(s) of the rims.

The safety surface may include the mat/tile. The safety surface may include no other mat/tile. The safety surface may include another, or more than one other, mat/tile. The safety surface may be disposed on at least part of the under-layer.

The safety surface may include an upper layer. The upper layer may overlie the mat/tile layer. An under-surface of the upper layer may be bonded to an upper surface of the mat/tile layer. A lower surface of the upper layer may be bonded to the upper surface of the mat/tile. The under-surface of the upper layer may be bonded to an upper surface of the loose fill within one or more pockets of the mat/tile. The lower surface of the upper layer may be bonded to the upper surface of the loose fill. The upper layer may be bonded to any auxiliary layers. Any auxiliary layers may be bonded to the upper surface of the loose fill.

The upper layer may be emplaced over the mat/tile layer. The upper layer may include a surface tiling. The upper layer may include a flooring surface. The upper layer may include rubber sheeting. The upper layer may include a rolled-out surfacing-mat. The upper layer may include synthetic turf. The upper layer may include foam-backed synthetic turf.

The upper layer may be poured-in-place over the mat/tile layer as a workable mixture. The mixture may include rubber particles and binder(s). An upper surface of the mixture may be leveled. The upper surface of the mixture may be smoothed. The mixture may be allowed to dry. The dry mixture may be the upper layer.

The upper level and the mat/tile layer emplaced upon the under-layer may be considered the safety surface. The safety surface may be wheelchair accessible. The mat/tile may be a structural element of the safety surface. The other mat/tile may be a structural element of the safety surface. More than one other mat/tiles may be structural elements of the safety surface. The safety surface may include other structural elements.

A support rib may support the mat/tile. The support rib may be engaged with the mat/tile. The support rib may be engaged with an additional, or more than one additional, mat/tile. The safety surface may include one, or more than one, support rib. The one support rib and the more than one support rib may be structural elements of the safety surface.

A border rail may border the mat/tile. The border rail may be engaged with the mat/tile. The border rail may be engaged with an additional, or more than one additional, mat/tile. The border rail may be engaged with the support rib. The border rail may be engaged with an additional, or more than one additional, support rib. The safety surface may include one, or more than one, border rail. The one border rail and the more than one border rail may be structural elements of the safety surface.

An anchor may anchor the mat/tile to a location. The anchor may anchor the support rib to a location. The anchor may anchor the border rail to a location. The safety surface may include one, or more than one, anchor. The one anchor and the more than one anchor may be structural elements of the safety surface.

A border alert marker may mark a location of a border of the safety surface. The location of the border of the safety surface may be marked visually, tactilely and/or via a signal. The signal may be an audio signal. The signal may be an electronic signal. The border alert marker may be associated with the mat/tile. The border alert marker may engage the mat/tile. The border alert marker may be associated with the support rib. The border alert marker may engage the support rib. The border alert marker may be associated with the border rail. The border alert marker may engage the border rail. The safety surface may include one, or more than one, border alert marker. The one border alert marker and the more than one border alert marker may be structural elements of the safety surface.

The tile edge of the mat/tile may be configured to engage at least one structural element of the safety surface. The tile edge of the mat/tile may be associated with the structural element. At least part of the tile edge of the mat/tile may be complementary in contour to part of the structural element. The tile edge of the mat/tile may incorporate a coupling receptacle configured to receive part of the structural element of the safety surface. The tile edge of the mat/tile may be continuous with a wall continuous with the receptacle. The tile edge of the mat/tile may be continuous with a wall of the receptacle. The tile edge of the mat/tile may support the receptacle.

When the mat/tile is disposed upon the under-layer, a bottom of the receptacle may be disposed near the under-layer. When the mat/tile is disposed upon the under-layer, the bottom of the receptacle may be disposed upon the under-layer. (With the bottom of the receptacle disposed upon the under-layer, the receptacle may provide support to the tile edge via the wall continuous between the tile edge and the receptacle.) The receptacle may receive part of the structural element of the safety surface. The receptacle may hold part of the structural element of the safety surface. The receptacle of a first mat/tile of the safety surface may include an interior contour structurally complementary to part of the exterior surface of a second mat/tile of the safety surface. The receptacle of the first mat/tile may receive part of one or more of the plurality of pockets of the second mat/tile. The interior contour of the receptacle of the first mat/tile may accommodate the one or more of the plurality of pockets of the second mat/tile. The interior contour may hold the one or more of the plurality of pockets of the second mat/tile. The holding of the one or more of the plurality of pockets of the second mat/tile by the interior contour may limit motion of the first mat/tile relative to the second mat/tile.

The tile edge of the mat/tile may adjoin the structural element. The tile edge of the mat/tile may abut the adjoined structural element. The tile edge of the mat/tile may underlie the adjoined structural element. The coupling receptacle may underlie the adjoined structural element. The tile edge of the mat/tile may overlie the adjoined structural element.

The tile edge of the mat/tile may be fastened to the structural element. The tile edge of the mat/tile may be riveted to the structural element. The tile edge of the mat/tile may be screwed to the structural element. The tile edge of the mat/tile may be interlocked with the structural element. The tile edge of the mat/tile may be zipped together with the structural element.

For example, the structural element may be another mat/tile. The tile edge of the mat/tile may be zipped together with the other mat/tile. For example, the tile edge of the mat/tile may feature a peg and/or a hole that may correspond to a complementary hole and/or peg of a tile edge of the other mat/tile. The peg of the tile edge of the mat/tile may be integral to the tile edge of the mat/tile. The peg of the tile edge of the mat/tile may be connected to the tile edge of the mat/tile. The peg of the tile edge of the mat/tile may be tapered away from its connection to the tile edge of the mat/tile; such a taper may allow for ease of alignment with, and insertion into, a hole of a tile edge of the other mat/tile. The peg of the tile edge of the mat/tile may be tapered toward its connection to the tile edge of the mat/tile; such a taper may prevent inadvertent removal of the peg from a hole of a tile edge of the other mat/tile. The peg of the tile edge of the mat/tile may engage a hole of a tile edge of the other mat/tile; the hole of the tile edge of the mat/tile may engage a peg of a tile edge of the other mat/tile. (Such interlocking structural features may be referred to as a "peg & hole" arrangement. Other geometries for interlocking adjoined edges may include "tongue & groove" arrangements. Other geometries for interlocking adjoined edges may include coupling the exterior surface of a pocket on a mat/tile to a cup-like receptacle on an adjoining mat/tile, the receptacle being complementary in interior contour to the exterior surface of the pocket. The receptacle may be open at top and/or bottom. The top and/or bottom of the receptacle may lie parallel to the under-layer.)

The apparatus may include, and the methods may involve, a safety surface for wheelchair accessibility. The safety surface may include one resilient tile. The safety surface may include at least two resilient tiles. The tile(s) may include rubber. The rubber may be derived from repurposed tires.

The tiles may be emplaced upon the under-layer. Each tile may include a plurality of empty pockets. Each of the pockets may have a rim. Each of the pockets may have an inner surface. The inner surface of the pockets may receive loose fill.

Some of the pockets may have one or more than onen aperture for allowing passage of fluid from the inner surface to the under-layer. A lower portion of an outer surface of at least one of the pockets may engage at least a part of the under-layer.

A plurality of tile edges may border the plurality of pockets. At least one of the plurality of tile edges of a first of the tiles may support a structure contoured interiorly complementary to part of the outer surface of one or more of the pockets of a second of the tiles. Complementarity of the interior contour and the outer surface may facilitate coupling of the one of the pockets with the structure. The one of the pockets may nest within the structure. The one of the pockets may be held within the structure. Multiple pockets of the second tile may be held within multiple structures supported along the least one of the plurality of tile edges of the first tile. Coupling the one or more of the pockets with one or more of the structures may limit relative movement of the first and second tiles.

The structure(s) may be configured to receive the pockets such that a pocket set into one of the structures may rest on or close to the under-layer. A side of the structure(s) closest to the under-layer may face the under-layer. The side of the structure(s) most proximal to the under-layer may lie parallel to the under-layer. The side of the structure(s) facing the under-layer may be closed. The side of the structure(s) facing the under-layer may be thin. The side of the structure(s) facing the under-layer may be at least partly open. The structure(s) may define an opening proximal to the under-layer. The opening may accommodate at least part of a bottom extremity of the set pocket. The opening may be dimensioned smaller than, equal to or larger than a face of the bottom extremity most proximal to the under-layer. A portion of the bottom extremity may pass through the opening.

Pockets(s) set into the structure(s) may be shifted upward from the under-layer. Pockets(s) set into the structure(s) may not be shifted upward from the under-layer. The bottom extremity of pockets(s) set into the structure(s) may engage the under-layer. Coupling the one or more of the pockets with the one or more structures may maintain the rims of the second tile at substantially the same height above the under-layer as the height above the under-layer of the rims of the first tile.

The first and the second tiles may be fastened together. The fastening may utilize hardware. The fastening may be achieved without hardware.

The pockets may be set into the structures before the pockets receive loose fill. The pockets may be set into the structures while the pockets receive loose fill. The pockets may be set into the structures after the pockets receive loose fill. The loose fill may include a resilient piece smaller than an inner volume of one of the pockets. One or more pieces may be received by the inner volume of the pocket(s). The pieces may include recycled material. The pieces may include shreds of rubber tires.

An upper layer of resilient material may be emplaced above the tile(s) of the safety surface. The upper layer of resilient material may be emplaced upon the tile(s). The upper layer may seal at least a portion of one or more than one rim. The upper layer may overlay the loose fill received within at least one of the pockets. The resilient material of the upper layer may include poured-in-place material. The resilient material of the upper layer may include rolled-out material. The resilient material of the upper layer may include synthetic turf. The resilient material of the upper layer may include dimensioned floor tiling material.

The safety surface may be manufactured on site. The site may be a playground. Manufacturing the safety surface on site may involve preparing the under-layer. Preparing the under-layer may include exposing at least part of the ground/flooring surface of the site. Preparing the under-layer may include excavating at least part of the site down to a level sufficient to accommodate the planned height of under-layer and of the safety surface desired to be below the surface level of the site. Preparing the under-layer may include tamping down the ground/flooring surface. Preparing the under-layer may include pouring or otherwise disposing to a depth upon the site, concrete, mineral aggregate, crushed stone or other suitable under-layer material. Preparing the under-layer may include leveling the material of the under-layer. Preparing the under-layer may include examining drainage properties of the under-layer. Preparing the under-layer may include adjusting drainage properties of the under-layer.

Manufacturing the safety surface on site may involve spreading loose fill upon one or more fill regions. The site may include no fill regions. Manufacturing the safety surface on site may involve emplacing the mat/tile on the under-layer. Loose fill of the fill region(s) may become nestled among and/or beneath the outer pocket shapes of the plurality of pockets of the emplaced mat/tile.

Manufacturing the safety surface may involve engaging the emplaced mat/tile with one, or more than one, structural element of the safety surface other than the mat/tile. Engaging the mat/tile with the one, or the more than one, structural element of the safety surface other than the mat/tile may involve engaging the tile edge of the mat/tile with the one, or the more than one, structural element of the safety surface other than the mat/tile. Hardware fasteners may be used to fasten the mat/tile to one, or the more than one, structural element. Fastening may be achieved without recourse to hardware fasteners. The mat/tile and/or the structural element(s) may feature integral structures that facilitate fastening. The integral structures may be featured on or near edges of the mat/tile and/or the structural element(s).

Manufacturing the safety surface may involve engaging the emplaced mat/tile, which may be a first mat/tile, with one or more second mat/tiles. The second mat/tile(s) may be emplaced upon the under-layer. The second mat/tile(s) may adjoin the first mat/tile. An edge of the second mat/tile(s) may adjoin one or more edges of the first mat/tile. The edge(s) of the second mat/tile(s) may engage the one or more edges of the first mat/tile. Hardware fasteners may be used to fasten the first mat/tile to the second mat/tile(s). Fastening of the mat/tiles to each other may be achieved without recourse to hardware fasteners. The first mat/tile and/or the second mat/tile(s) may feature integral structures that facilitate fastening of the mat/tiles. The integral structures may facilitate engagement of adjoining mat/tiles. The integral structures may facilitate coupling of adjoining mat/tiles. The integral structures may facilitate interlocking of adjoining mat/tiles. Hardware fasteners may be used to secure mat/tiles to each other.

The integral structures of the first mat/tile and/or the second mat/tile(s) may be featured on or near edges of the first mat/tile and/or of the second mat/tile(s). The integral structures may be supported on or near edges of the first mat/tile and/or of the second mat/tile(s). The integral structures may be defined by edges of the first mat/tile and/or of the second mat/tile(s).

The integral structures may include peg & hole arrangements. The integral structures may include tongue & groove arrangements. The integral structures may include any other arrangements suitable for facilitating adjoining, engagement, coupling and/or fastening of mat/tiles to one another.

The other suitable arrangements may include an array of one or more receptacles integral to the first mat/tile. The pockets may attach to the rest of the first mat/tile along one of more edges of the first mat/tile. The receptacles may be configured to receive an exterior surface of pocket(s) of second mat/tile(s). Pocket(s) received by receptacles may lie along edges of the second mat/tile(s). The first mat/tile may have edges free of receptacles. The first mat/tile may some edges free of receptacles and other edges featuring receptacles. The second mat/tile(s) may some edges free of receptacles and other edges featuring receptacles. Pockets along receptacle-free edges of the first mat/tile may be received by receptacles of one or more than one second mat/tile. Receptacles of the second mat/tile(s) may receive pockets of the first mat/tile. Receptacles of the second mat/tile(s) may receive pockets of other second mat/tile(s). The receptacle may be cup-like. A cup of the receptacle may be open on top. The receptacles may be dimensioned with an interior contour complementary to the exterior surfaces of received pockets. The receptacles may be interiorly contoured to parallel parts of pocket exterior surfaces. The receptacles may be contoured to accommodate pocket outer shapes. The receptacles may engage pocket outer shapes. Engagement of receptacles with pockets may involve setting the exterior surfaces of the pockets into the receptacles.

The receptacles may contact pocket outer shapes. The receptacles may hold pocket outer shapes. The receptacles may limit lateral (in the plane of the safety surface) movement of received pockets.

The top and bottom of the receptacle may parallel each other. The top and/or bottom of the receptacles may parallel the under-layer. The receptacles may be open at bottom.

Manufacturing the safety surface may involve setting the exterior surface of pockets of the first mat/tile into the receptacles of the second mat/tile(s). Manufacturing the safety surface may involve setting the exterior surface of pockets of the second mat/tile(s) into the receptacle(s) of the first mat/tile. Manufacturing the safety surface may involve setting the exterior surface of pockets of the second mat/tile(s) into the receptacle(s) of the other second mat/tile(s). Setting the pockets into the receptacles may limit movement of the exterior surface of the pockets set into the receptacle.

Manufacturing the safety surface may involve overlaying at least part of the interior surface of one of the pockets of the mat/tile(s) with loose fill of the cover layer. None of, some of or all of the pockets of all mat/tiles of the safety surface may contain loose fill. None of, some of or all of the pockets of all mat/tiles of the safety surface may be filled with loose fill. None of, some of or all of the pockets of all mat/tiles of the safety surface may be packed with loose fill. None of, some of or all of the pocket rims of all mat/tiles of the safety surface may be covered with loose fill.

Manufacturing the safety surface may involve leveling the loose fill overlying the mat/tile(s). The loose fill overlying the mat/tile(s) may be raked, boarded or otherwise smoothed down. The loose fill overlying the mat/tile(s) may be leveled and/or smoothed to expose a part of one or more pocket rims. The loose fill overlying the mat/tile(s) may be leveled and/or smoothed to expose a part of one or more tile edges.

Manufacturing the safety surface may involve overlying the mat/tile(s) with one or more layers of material. Manufacturing the safety surface on site may involve overlying with one or more materials the mat/tile(s) overlain by the loose fill. The one or more material(s) may include auxiliary layers. The auxiliary layer(s) may include resilient material. The auxiliary layer(s) may include adhesive(s) to bond selected surfaces. The auxiliary layer(s) may include solvent to soften the selected surfaces. The selected surfaces may include upper surfaces of tile edges. The selected surfaces may include pocket rims. The selected surfaces may include lower surfaces of other auxiliary layers. The selected surfaces may include lower surfaces of the upper layer. The upper layer may seal the pockets from above. The upper layer may seal the loose fill within the pockets.

The upper layer may include one or more surface tilings. The surface tiling(s) may include a resilient thermoplastic elastomer. The surface tilings may be adjoined edge-to-edge to produce a unitary upper layer. The upper layer may include one or more flooring surfaces. The flooring surface(s) may include wood. The wood may be in the form of wood fibers. The flooring surfaces may be adjoined edge-to-edge to produce a unitary upper layer. The upper layer may include one or more rubber sheets. The rubber sheets may be adjoined edge-to-edge to produce a unitary upper layer.

The upper layer may include one or more rolled-out surfacing mats. The rolled-out surfacing-mat(s) may include synthetic turf. The rolled-out surfacing-mat(s) may include an upper region of synthetic turf. The rolled-out surfacing-mat(s) may include a lower region of foam rubber or other resilient material. The rolled-out surfacing-mats may be adjoined edge-to-edge to produce a unitary upper layer.

Manufacturing the safety surface may involve pouring-in-place over the mat/tile layer and/or over any auxiliary layers, a mixture of pieces (such as particles, crumbs and/or shreds) of resilient material and binder that, upon drying, may form the upper layer. The poured-in-place upper layer of resilient material may overlie the mat/tile layer. The poured-in-place upper layer may bond to the pocket rims and/or to any auxiliary layers. The poured-in-place upper layer may bond to upper surfaces of the tile edges. The poured-in-place upper layer may bond to upper surfaces of the fasteners mechanically connecting adjoined mat/tiles. The poured-in-place upper layer may seal the pockets from above. The poured-in-place upper layer may seal the loose fill within the pockets.

Pouring the mixture may be a sequential process, with more than one pouring layering the same or different materials into the upper layer. The mixture may be leveled and/or smoothed. An upper surface of the mixture may be textured. The upper layer may provide a relatively smooth unitary surface.

The safety surface of the engineered mat/tile layer and the upper layer may combine high accessibility (as for wheelchairs) with enhanced impact attenuation for safety.

At the same time that the upper layer may provide a wheelchair accessible surface, the engineered mat/tile layer with its combination of mat/tile(s) and loose fill may maintain a high safety factor for the site.

A measure of the high safety factor may be given by head impact test results. Tests were conducted on a safety surface of the present invention including the engineered mat/tile layer (an embodiment of about 3 inches height, with square pyramids of wall-thickness about 0.25 inch) containing loose fill overlain by an about 0.5 inch thick poured-in-place upper level. Tests were also conducted on the same embodiment engineered mat/tile layer containing loose fill overlain by an about 1.25 inches synthetic turf layer. Certified third-party head impact testing (see Appendices A and B) for an eight (8) foot drop was conducted with equipment from Triax Technologies, Inc. (Norwalk, Conn.), based on ASTM F1292-13, yielding Head Injury Criteria (HIC) values and Gmax values. Under such test conditions, standard unitary safety surface systems currently available typically yield HIC values of about 700 and Gmax values of 125. By contrast, test results of the safety surface of the present invention were HIC values of under 310 and Gmax values of under 85. These results may reflect exceptional safety characteristics and performance of the present invention.

In certain embodiments, the safety surface can be installed in some or all of a playground or other suitable area. The safety surface can be installed along access routes of the playground or other suitable area. The access routes may typically account for half the area of the playground or other suitable area.

The pockets of the mat/tile can be engineered having a depth of about 3", any depth from between about 1" and about 6", or any other suitable depth. Other suitable depths may include about 2". Other suitable depths may include about 7". Some embodiments of the pockets may feature the aperture at a downward-facing portion of the lowermost extremity of the pocket. The aperture may allow water and/or other liquid to drain out of the interior concavity of the pocket. The aperture may allow water and/or other liquid to drain onto the under-layer underlying the mat/tile layer.

The aperture may not allow components of the loose fill in the pocket to enter the aperture. While it may be preferable to locate the aperture at the downward-facing portion of the extremity, aperture(s) may be placed, alternatively or additionally, anywhere along geometric faces of the pockets' outer shape.

In one embodiment, in which the mat/tile may be square, the size of the mat/tile may range from about 12"×12" to about 48"×48", or may be of any other suitable square size. The mat/tile can be made smaller than 12"×12". The mat/tile can be made larger than 48"×48".

In one embodiment, an about 36" by 36" square mat/tile may be used. In such an embodiment, there may be 9 pockets by 9 pockets for a total of 81 pockets, the pockets having a square upper perimeter and an inverted square pyramidal outer pocket shape. In such an embodiment, a side of the square pocket upper perimeter may be slightly less than about 3.5". A thickness of the resilient material of walls of the pockets may be about ¼". A lowest extremity of the pockets may about 3" below an upper pocket edge. A portion of the lowest extremity of the pockets may be dimensioned as an about ½" by ½" square. A width of the pocket upper edge may be slightly less than ½". In other embodiments, such dimensions may be different. For example, in other embodiments, a side of the square pocket upper perimeter may be between about 1½" or about 4½", or any other suitable length. In other embodiments, the width of the pocket upper edge may be may be between about ¼" and about 1½", or any other suitable width.

Receptacles of the mat/tile for engaging pockets of other mat/tiles may be attached to the rest of the mat/tile along one or more than one edge. In an embodiment using an about 36" by 36" square mat/tile and featuring 9 pockets by 9 pockets—each of upper square perimeter side length about 3.5"; height of about 3"; and of inverted square pyramidal outer pocket shape with a portion of a lowest extremity having a square "footprint" of ½" by ½"—a mat/tile edge (or multiple adjacent or non-adjacent edges) may feature a row of nine receptacles, each receptacle in line with one of the edge's nine pockets and extending outward and downward from the edge. A configuration of the receptacle inner walls may be geometrically complementary to mat/tile square pyramidal outer pocket shapes. Mat/tile square pyramidal outer pocket shapes of other mat/tiles may be set into the receptacles. A portion of a lowest extremity of each receptacle may be coplanar with the lowest extremities of the mat/tile's pockets. Sides of receptacles not ascending to the mat/tile edge may have a height above the under-layer of about 1.25". The sides of the receptacles may cup a low portion of the outer pocket shape of pockets set into the receptacles. A bottom face of the receptacles may feature a ½" by ½" square opening. The "footprints" of pockets set into the receptacles may be accommodated by the opening in the receptacle bottom face.

Similar size and/or shape mat/tiles may be engaged in the safety surface. Different size and/or shape mat/tiles may be engaged in the safety surface. Mat/tiles may be engaged to one another, and/or to other structural elements of the safety surface, along mat/tile peripheries, preferably along tile edges.

The upper layer may be available in a variety of colors. One color option may be black. Black may be the most available color for recycled rubber. Vibrant color(s) may be used to match play equipment. Such color(s) can be formed by adding pigment(s) to the substance(s) of one or more applications of the poured-in-place mixture.

In one embodiment, the safety surface may be installed on-site using the following method of installation. A selection of the number, size(s) and shape(s) of mat/tiles to be installed may be determined and/or confirmed by assembling mat/tiles, either virtually and/or physically, into a desired configuration upon an area designated for the installation. Other structural elements, such as support ribs and border rails may be similarly configured. The selected structural elements of the configuration may be inspected. Apertures of selected mat/tiles may be inspected; any aperture-blocking mat/tile substance(s) may be selectively removed. The configuration of structural elements may be disassembled. The selected structural elements may be shifted from the designated area to allow for subsequent steps of installation.

Loose fill may be spread to a suitable depth over no, some or all fill regions of the under-layer. Alternatively and/or additionally, loose fill surface material may be spread on any playground under-layer or on any other suitable surface. Other suitable surfaces may include the ground/flooring surface.

The area of the surface to be overspread by the safety surface may be at least partly delimited by border rails. Border rails may allow for a play area with a top play surface above the level of surrounding terrain. The area of the surface to be overspread may be set by excavating the area to a depth sufficient to accommodate the height desired to be below terrain level of the under-layer, the mat/tile layer and the upper layer.

The mat/tile may be laid upon the ground/flooring surface. The mat/tile may be laid upon the under-layer.

The mat/tile may be adjoined to additional mat/tiles laid upon the ground/flooring surface and/or upon the under-layer. Mat/tiles may be adjoined directly to each other. Mat/tiles may be adjoined indirectly to each other by adjoining mat/tiles to support ribs and/or to border rails.

Before engaging the structural elements laid out in the desired configuration upon the ground/flooring surface and/or upon the under-layer, the configuration may be checked. The mat/tiles (and any support ribs) may be leveled. Adjoined peripheries, such as tile edges, may be checked and adjusted for complementarity and readied for engagement. Excess mat/tile area may be trimmed at borders of the area, yielding, for example, a trimmed-to-size mat/tile periphery complementary to a border rail. Anchors, such as spikes securing the location of border rails, may be set in place. Anchors, such as weighted bands of rubber connected to, looped below and securing the location of mat/tiles and/or support ribs, may be set in place. Such checking, leveling, readying, trimming, setting and/or other suitable processes may be ongoing and/or repeated as the structural elements are being engaged.

The structural elements laid out in the desired configuration may be engaged to produce a framework of the mat/tile layer.

Adjoined structural elements may be engaged without fasteners. For example, a trimmed-to-size periphery of a mat/tile may closely abut a border rail.

Adjoined structural elements may feature complementarily interlocking peripheries. Complementarily interlocking peripheries may include tile edges featuring peg & hole arrangements, tongue & groove arrangements, pocket-receiving receptacles or any other arrangement suitable for facilitating adjoining, engagement, coupling, fastening and/or securing of safety surface components to one another.

Adjoined structural elements may be engaged via fasteners. Any suitable fastener may be used to engage adjoined structural elements. Suitable fasteners may include clips and rivets. Rivets may include pop rivets. Suitable fasteners may include screws. For example, the mat/tile may be fastened to a support rib by securely setting a screw through an overlap of the tile edge of the mat/tile and of the support rib. The screws may include stainless steel. The screws may include hard rubber. The screws may include any other suitable substance. Other suitable substances, particularly for an interim playground, may include a biodegradable polymer. Aligned pre-drilled holes in the support rib and the tile edge may expedite such a fastening process.

Border alert markers may be installed and/or activated at strategic locations along the periphery of the safety surface. Border alert markers may signal an alert as to a location of the periphery. Border alert markers may be passive indicators of the periphery, such as colored rubber poles or colored flags. Passive indicators may include structural elements with upper surfaces featuring wide deep ridges that may induce vibrations in wheelchair motion. Border alert markers may be active indicators of the periphery, such as generators of focused sonic patterns detectable in approaching the periphery from within the area of the safety surface. Sonic patterns may be in an audible range. Sonic patterns may be in a subsonic range that may induce tactile vibrations. Border alert markers may be interactive indicators of the periphery, such as detectors sensitive to ambulatory or wheelchair approach, logically coupled with appropriate mechanisms of signal generation.

The loose fill may be spread over the mat/tile(s). The loose fill may be sufficient to fill the pockets of the mat/tile(s).

The mixture may be spread and smoothed over the mat/tile layer. The mixture may bond to the mat/tile layer and, upon drying, may serve as the upper layer of the safety surface. The upper layer of the safety surface, in conjunction with the layered safety surface components beneath it, may provide a unitary seamless surface with high wheelchair accessibility and high impact attenuation.

Apparatus and methods in accordance with the invention will now be described in connection with the FIGS., which form a part hereof. The FIGS. show illustrative features of apparatus and methods in accordance with the principles of the invention. The features are illustrated in the context of selected embodiments. It will be understood that features shown in connection with one of the embodiments may be practiced in accordance with the principles of the invention along with features shown in connection with another of the embodiments.

Apparatus and methods described herein are illustrative. Apparatus and methods of the invention may involve some or all of the features of the illustrative apparatus and/or some or all of the steps of the illustrative methods. The steps of the methods may be performed in an order other than the order shown and described herein. Some embodiments may omit steps shown and described in connection with the illustrative methods. Some embodiments may include steps that are not shown and/or not described in connection with the illustrative methods.

The apparatus and methods of the invention will be described in connection with embodiments and features of illustrative devices. It is to be understood that other embodiments may be utilized and that structural, functional and procedural modifications may be made without departing from the scope and spirit of the present invention.

FIG. 1 shows rubber-mat-based safety surface 100.

Safety surface 100 may be emplaced upon under-layer 115. Under-layer 115 may underlie a site of safety surface 100. Under-layer 115 may be a pre-existing feature of the site. Under-layer 115 may be prepared for on-site manufacture of safety surface 100. Under-layer 115 may be level. Under-layer 115 may provide drainage.

Under-layer 115 may include mineral aggregate. Under-layer 115 may include crushed stone. Under-layer 115 may include concrete. Under-layer 115 may include any other suitable material. Other suitable material may include packed earth. Other suitable material may include bedrock. Other suitable material may include asphalt. Other suitable material may include metal. Other suitable material may include wood. The wood may be part of flooring.

Safety surface 100 may include mat/tile layer 105. Mat/tile layer 105 may be disposed above under-layer 115. Mat/tile layer 105 may disposed upon under-layer 115.

Mat/tile layer 105 may include engineered mat/tile 1010. Mat/tile layer 105 may include two or more mat/tiles 1010. Mat/tile layer 105 may include a portion of mat/tile 1010. Mat/tile 1010 may lie above under-layer 115. Mat/tile 1010 may lie upon under-layer 115. Mat/tile 1010 may be emplaced upon under-layer 115. Mat/tile 1010 may contact under-layer 115. A portion of an exterior surface of mat/tile 1010 may contact under-layer 115.

Mat/tile layer 105 may include loose fill. Portions of loose fill may be represented in these FIGS. by dots and/or clumps depicted beneath, within and/or above mat/tile 1010. Mat/tile layer 105 may include loose fill 116. Loose fill 116 may lie beneath mat/tile 1010. Loose fill 116 may lie above under-layer 115. Loose fill 116 may lie upon under-layer 115. Loose fill 116 may lie between under-layer 115 and mat/tile 1010.

Mat/tile layer 105 may include loose fill 117. Loose fill 117 may lie within and/or above mat/tile 1010.

Mat/tile 1010 may include one or more hollow pockets 102. Mat/tile 1010 may include convex exterior surface 101. Exterior surface 101 may include an exterior surface of pocket 102. Pocket 102 may include concave interior surface 103 (shown partly covered by loose fill 117).

Pocket 102 may include aperture 104. Pocket 102 may include low extremity 109. Aperture 104 may be disposed in a bottom portion of pocket 102. Aperture 104 may be disposed in extremity 109. Aperture 104 may allow passage of fluid from interior surface 103 to under-layer 115.

Pocket 102 may engage under-layer 115. Exterior surface 101 may engage under-layer 115. A bottom portion of exterior surface 101 may engage under-layer 115. Extremity 109 may engage under-layer 115.

Exterior surface 101 may engage loose fill 116. Loose fill 116 may be nestled against, and/or stabilized by, exterior surface 101. A No-fill Region below mat/tile 1010 may be free of loose fill 116. The No-fill Region may underlie none, some or all of mat/tile 1010. The No-fill Region may underlie none, some or all of safety surface 100. A Fill Region below mat/tile 1010 may include loose fill 116. The Fill Region may underlie none, some or all of mat/tile 1010. The Fill Region may underlie none, some or all of safety surface 100.

Pocket 102 may include pocket rim 107. Pocket rim 107 may include an upper perimeter of pocket 102. A topmost level of mat/tile 1010 may include a topmost surface of pocket rim 107.

Loose fill 117 may be nestled within, and/or stabilized by, pocket 102. Loose fill 117 may cover interior surface 103. Loose fill 117 may fill pocket 102 up to pocket rim 107. Loose fill 117 may cover mat/tile 1010 up to the topmost level of mat/tile 1010. Loose fill 117 may rise above the topmost level of mat/tile 1010.

Mat/tile 1010, in conjunction with loose fill 117, may provide a resilient surface upon which to emplace upper layer 118. Auxiliary layers (not shown) may be disposed between mat/tile 1010 and upper layer 118. Upper layer 118 may include a surface tiling, a flooring surface, a rubber sheet, a rolled-out mat-surfacing and/or a poured-in-place surface. (In this FIG., upper layer 118 is depicted as transparent, for illustrative purposes, to show components of safety surface 100 that lie below typically opaque upper surface 118.)

Mat/tile 1010, in conjunction with loose fill 117, may provide a resilient surface upon which to apply a mixture of particles and binder that, upon drying, includes upper layer 118. The mixture may include resilient particles. The mixture may include one or more binders. The resilient particles may include crumb rubber. The resilient particles may include shredded rubber. The binders may include aliphatic urethane or any other suitable substances. Other suitable substances may include aromatic urethane.

The rubber may include synthetic rubber. The synthetic rubber may include styrene-butadiene rubber ("SBR"). The synthetic rubber may include ethylene propylene diene monomer rubber ("EPDM"). EPDM may be colored. EPDM may be added to SBR in the mixture. Alternatively and/or additionally, a sheet or skin of EPDM may be applied to an upper exterior surface of a SBR-containing mixture. Addition of EPDM may add durability to upper layer 118. Addition of EPDM may increase staying power of a color of upper layer 118. The synthetic rubber may include any suitable material. Any suitable material may include a thermoplastic vulcanizate ("TPV"). Any suitable material may include other thermoplastic elastomers ("TPE").

The rubber may include natural rubber. The rubber may include any suitable combination of natural rubber and synthetic rubber, whether recycled or virgin.

Safety surface 100 may include a poured-in-place ADA-compliant safety surface.

Upper layer 118 may include a substantially flat top surface. The top surface of upper layer 118 may include a texture.

Upper layer 118 may bond to mat/tile 1010. Upper layer 118 may bond to pocket rim 107. Upper layer 118 may bond to interior surface 103. Upper layer 118 may bond to loose fill 117. Upper layer 118 may seal loose fill 117 in pocket 102.

Upper layer 118 may be of suitable thickness to provided mechanical strength, durability and resilience to safety surface 100. Suitable thickness may depend upon the expected exposure of safety surface 100 to factors such as sunlight, temperature and wetness. Suitable thickness may depend upon the expected use of safety surface 100. Suitable thickness may range from about ¼" to ½", from about ½" to ¾", from about ¾" to 1", from about 1" to 1¼", from about 1¼" to 1½", from about 1½" to 1¾", from about 1¾" to 2", from about 2" to 2¼", from about 2¼" to 2½", from about 2½" to 2¾", from about 2¾" to 3", from about 3" to 3¼", from about 3¼" to 3½", from about 3½" to 3¾", from about 3¾" to 4", and any other suitable thickness. Any other suitable thickness may include less than about ¼". Any other suitable thickness may include more than about 4". For poured-in-place upper layer 118, suitable thickness may depend upon the material of the mixture.

Figure 2:
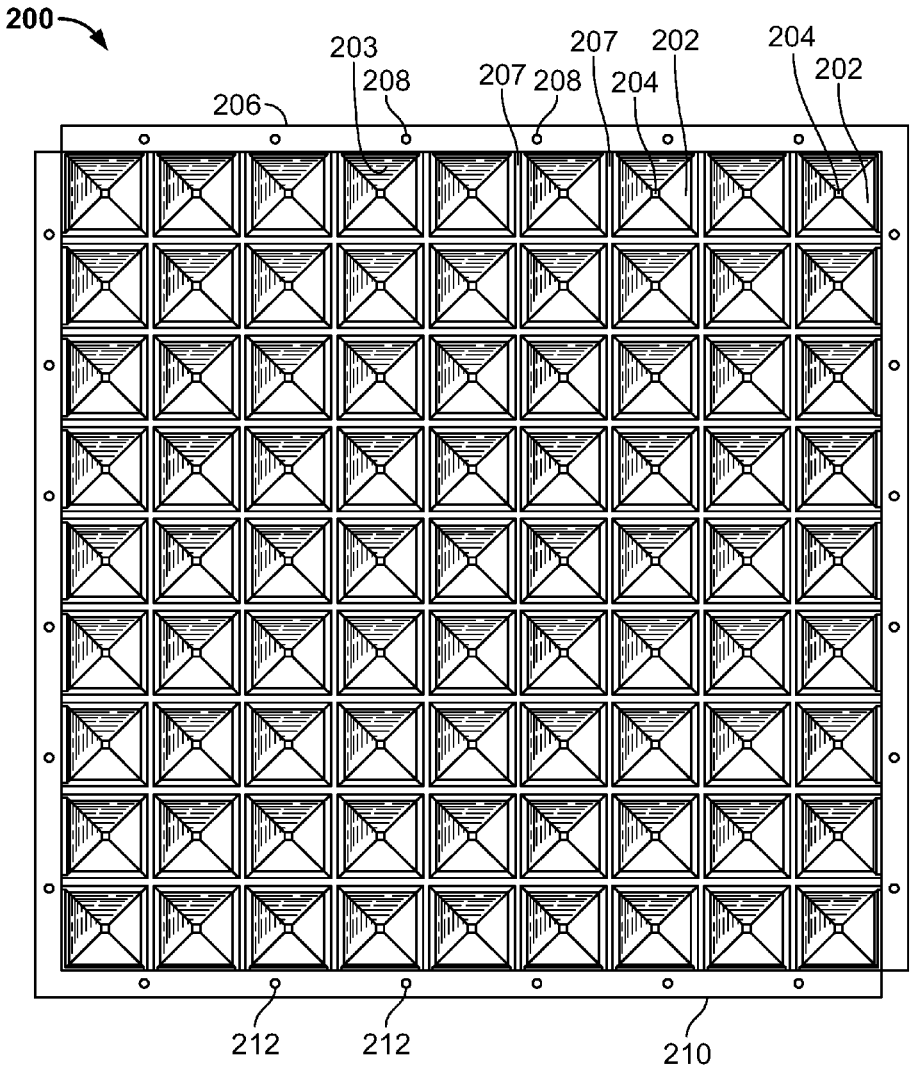
FIG. 2 is a top plan view of apparatus in accordance with principles of the invention.

FIG. 2 shows mat/tile 200. Mat/tile 200 may have one or more features in common with mat/tile 1010 (shown in FIG. 1). Mat/tile 200 may be square.

Mat/tile 200 may include pockets 202. Pockets 202 may include concave interior surface 203. In the top plan view of FIG. 2, inner surface 203 is depicted receding downward toward a bottom of pockets 202. Pockets 202 may be shaped as hollow inverted square pyramids.

Pockets 202 may include apertures 204. Apertures 204 may be located at the bottom of pockets 202. Apertures 204 may be centered within pockets 202.

Mat/tile 200 may include tile edge 206. Tile edge 206 may border pockets 202. Tile edge 206 may border pocket rims 207. Pocket rims 207 may be part of square upper perimeters of pockets 202.

Tile edge 206 may include pegs 208.

Mat/tile 200 may include tile edge 210. Tile edge 210 may border pockets 202. Tile edge 210 may border pocket rims 207. Tile edge 210 may include holes 212.

Holes 212 may be configured to receive pegs on another structural element, such as a mat/tile or a support rib. Pegs 208 may be configured to be received by holes on another structural element, such as a mat/tile or a support rib. Such peg & hole arrangements (presented in more detail below, in description of FIGS. 6 and 7) may be used to effect engagement of structural elements.

Figure 3:
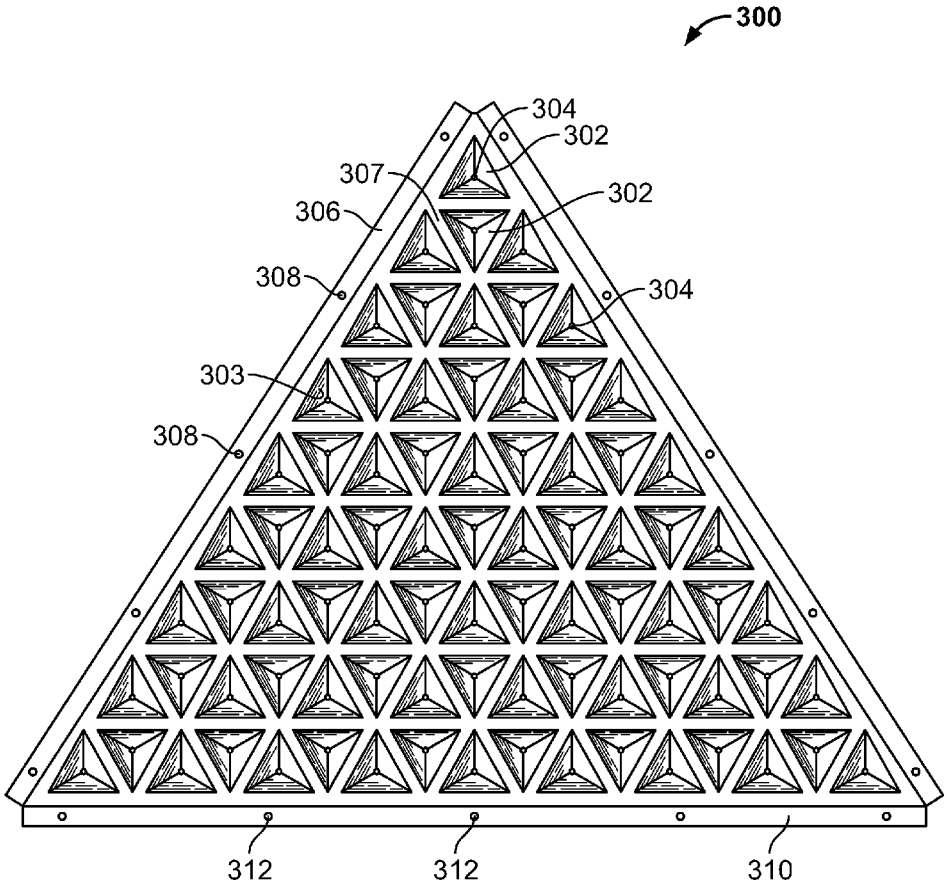
FIG. 3 is a top plan view of apparatus in accordance with principles of the invention.

FIG. 3 shows mat/tile 300. Mat/tile 300 may have one or more features in common with one or more of mat/tiles 1010 (shown in FIG. 1) and 200 (shown in FIG. 2). Mat/tile 300 may be triangular.

Mat/tile 300 may include pockets 302. Pockets 302 may include concave interior surface 303. In the top plan view of FIG. 3, inner surface 303 is depicted receding downward toward a bottom of pockets 302. Pockets 302 may be shaped as hollow inverted tetrahedra.

Pockets 302 may include apertures 304. Apertures 304 may be located at the bottom of pockets 302. Apertures 304 may be centered within pockets 302.

Mat/tile 300 may include tile edge 306. Tile edge 306 may border pockets 302. Tile edge 306 may border pocket rims 307. Pocket rims 307 may be part of triangular upper perimeters of pockets 302.

Tile edge 306 may include pegs 308.

Mat/tile 300 may include tile edge 310. Tile edge 310 may border pockets 302. Tile edge 310 may border pocket rims 307. Tile edge 310 may include holes 312.

Holes 312 may be configured to receive pegs on another structural element. Pegs 308 may be configured to be received by holes on another structural element.

Figure 4:
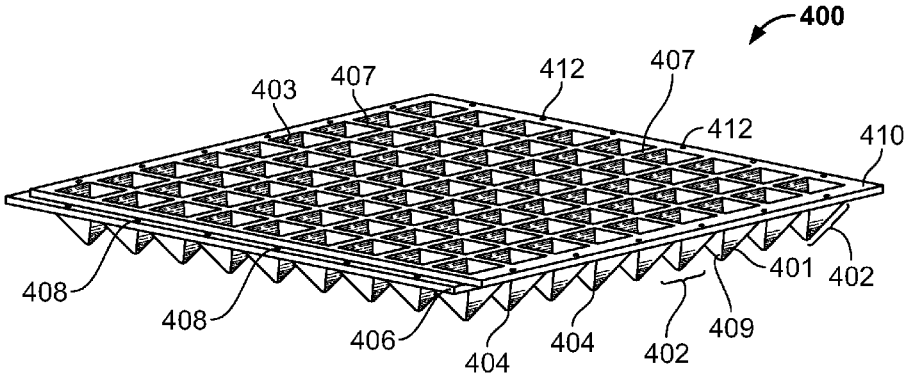
FIG. 4 is a perspective view of apparatus in accordance with principles of the invention.

FIG. 4 shows mat/tile 400. Mat/tile 400 may have one or more features in common with one or more of mat/tiles 1010 (shown in FIG. 1), 200 (shown in FIG. 2) and 300 (shown in FIG. 3).

Mat/tile 400 may include convex exterior surface 401. Convex exterior surface 401 may be part of pockets 402.

Pockets 402 may include concave interior surface 403. Pockets 402 may be shaped as hollow inverted square pyramids. Exterior surface 401 may be part of a geometric face of the inverted square pyramids of pockets 402. Lowermost extremities 409 may be downward facing apices of the inverted square pyramids.

Pockets 402 may include apertures 404. Apertures 404 may interrupt exterior surface 401. Apertures 404 may truncate the inverted square pyramids. The inverted square pyramids, as depicted, may feature blunted apices. Blunted apices may indicate the presence of apertures 404.

Mat/tile 400 may include tile edge 406. Tile edge 406 may border pockets 402. Tile edge 406 may border pocket rims 407. Pocket rims 407 may be part of square upper perimeters of pockets 402.

Tile edge 406 may include pegs 408.

Mat/tile 400 may include tile edge 410. Tile edge 410 may border pockets 402. Tile edge 410 may border pocket rims 407. Tile edge 410 may include holes 412.

Figure 5:
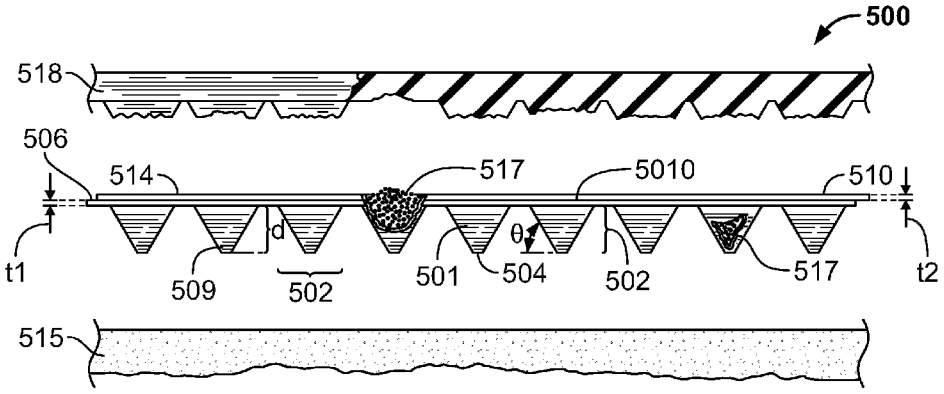
FIG. 5 is an exploded, side view of apparatus in accordance with principles of the invention, including cutaways of external features providing views of internal features of the apparatus.

FIG. 5 shows rubber-mat-based safety surface 500. Safety surface 500 may have one or more features in common with safety surface 100 (shown in FIG. 1). Safety surface 500 may be a poured-in-place ADA-compliant safety surface.

Safety surface 500 may be emplaced upon under-layer 515. Under-layer 515 may have one or more features in common with under-layer 115 (shown in FIG. 1).

Safety surface 500 may include mat/tile 5010. Mat/tile 5010 may have one or more features in common with one or more of mat/tiles 1010 (shown in FIG. 1), 200 (shown in FIG. 2), 300 (shown in FIG. 3) and 400 (shown in FIG. 4).

Mat/tile 5010 may include pockets 502. Pockets 502 may include exterior surface 501. Pockets 502 may include aperture 504. Aperture 504 may interrupt exterior surface 501. An interruption of exterior surface 501 by aperture 504 may be proximal to a downward-facing extremity 509. Aperture 504 may pass through downward-facing extremity 509.

Pockets 502 may feature depth d. Depth d may represent a depth of pockets 502. Depth d may be any suitable depth.

Pockets 502 may feature angle θ. Angle θ may represent an angle of an exterior side of pockets 502 with respect to a horizontal plane of mat/tile 5010. Angle θ may be any suitable angle.

Mat/tile 5010 may include tile edge 506. Tile edge 506 may include thickness t1. Thickness t1 may represent the thickness of tile edge 506. Thickness t1 may be any suitable thickness.

Mat/tile 5010 may include tile edge 510. Tile edge 510 may include thickness t2. Thickness t2 may represent the thickness of tile edge 510. Thickness t2 may be any suitable thickness.

Line 514 may represent a topmost level of mat/tile 5010. Overall height of mat/tile 5010 may be given by a distance along a perpendicular (not shown) from line 514 to a bottom-most portion of downward-facing extremity 509. Overall height of mat/tile 5010 may be given by a sum of thickness t1 plus thickness t2 plus depth d. Overall height of mat/tile 5010 may be 2½, 2¾, 3", 3¼, 3½" or any suitable height. Any suitable height may include 2", 2¼", 3¾", or 4".

Mat/tile 5010 may be filled with loose fill 517. Loose fill 517 may be layered upon mat/tile 5010. Loose fill 517 may be loaded into pockets 502. Loose fill 517 may fill pockets 502. Loose fill 517 may occupy a low section of pocket 502 (as shown in cutaway of pocket 502). Individual components of loose fill 517 may be too small to fit through aperture 504. Individual components of loose fill 517 may be too small to fit into aperture 504.

Loose fill 517 may occupy a high section of pocket 502 (as shown in cutaway of pocket 502). Loose fill 517 may fill pocket 502 above line 514.

Upper layer 518 (shown in exploded view, vertically removed from mat/tile 5010) may have one or more features in common with upper layer 118 (shown in FIG. 1).

Upper layer 518 may have been emplaced upon mat/tile 5010. Upper layer 518 may have been rolled out upon mat/tile 5010. Upper layer 518 may have been poured-in-place upon mat/tile 5010 as a workable mixture that was smoothed and allowed to dry to form upper layer 518. A bottom surface of upper layer 518 may conform to contours of an upper surface of mat/tile 5010. A bottom surface of upper layer 518 may conform to contours of an upper surface of loose fill 517 within pockets 502 (as shown in cutaway of upper layer 518). Upper layer 518 may bond to upper surfaces of mat/tile 5010 (such as pocket rims, shown in FIG. 4 as pocket rim 407). Upper layer 518 may bond to exposed interior surfaces of mat/tile 5010 (such as concave interior pocket surfaces, shown in FIG. 4 as interior surface 403). Upper layer 518 may bond to interior surfaces of mat/tile 5010 not covered by loose fill 517. Upper layer 518 may bond to exposed surfaces of loose fill 517. Adhesive(s) (not shown) between upper layer 518 and mat/tile 5010 may contribute to the bonding. Upper layer 518 may seal loose fill 517 within pockets 502.

Figure 6:
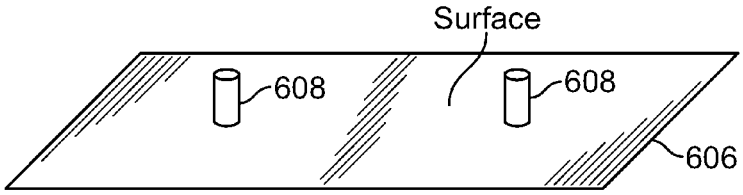
FIG. 6 is an enlarged view of one or more features of apparatus in accordance with principles of the invention.

FIG. 6 shows a portion of tile edge 606. Tile edge 606 may include pegs 608. Pegs 608 may be similar to pegs 208 (shown in FIG. 2). Pegs 608 may be similar to pegs 308 (shown in FIG. 3). Pegs 608 may be similar to pegs 408 (shown in FIG. 4). Pegs 608 may be similar to pegs of peg & hole arrangements in other structural elements (not shown).

Peg 608 may be connected to a surface of tile edge 606 at a proximal end of peg 608. In certain embodiments, tile edge 606 may include pegs 608 that enlarge (not shown) toward distal ends of pegs 608.

Figure 7:
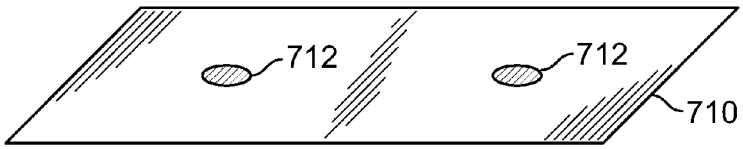
FIG. 7 is enlarged view of one or more features of apparatus in accordance with principles of the invention.

FIG. 7 shows a portion of tile edge 710. Tile edge 710 may include holes 712. Holes 712 may be similar to holes 212 (shown in FIG. 2). Holes 712 may be similar to holes 312 (shown in FIG. 3). Holes 712 may be similar to holes 412 (shown in FIG. 4). Holes 712 may be similar to holes of peg & hole arrangements in other structural elements (not shown).

In embodiments with tile edge 606 (shown in FIG. 6) including pegs 608 that enlarge (not shown) toward distal ends of pegs 608, pegs 608 may lock into holes 712 such that a special tool may be required to engage tile edge 606 to tile edge 710. In such embodiments, a special tool may be required to disengage the engaged tile edges.

Figure 8:
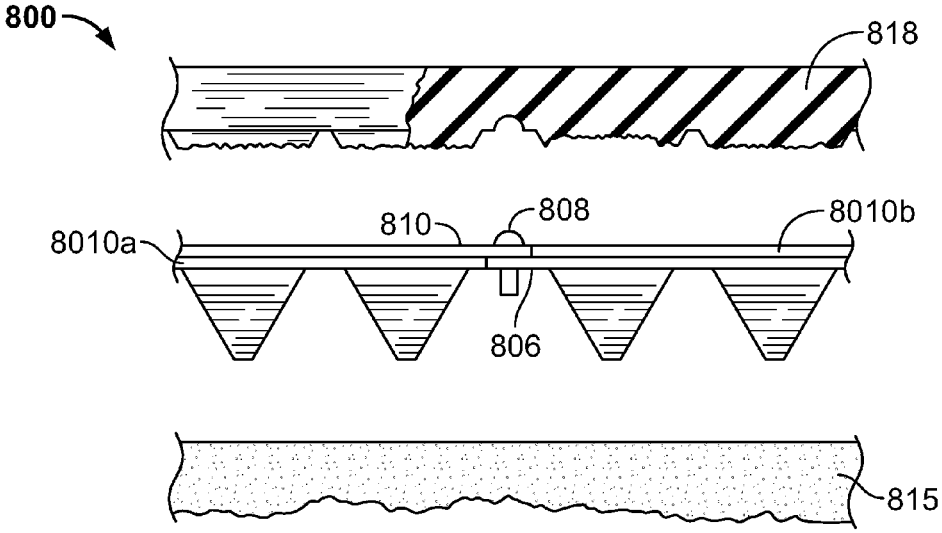
FIG. 8 is an exploded, side view of apparatus in accordance with principles of the invention, including a cutaway of external features providing a view of internal features of the apparatus.

FIG. 8 shows rubber-mat-based surface 800. Safety surface 800 may have one or more features in common with one or more of safety surfaces 100 (shown in FIG. 1) and 500 (shown in FIG. 5). Safety surface 800 may be a poured-in-place ADA-compliant safety surface.

Safety surface 800 may be emplaced upon under-layer 815. Under-layer 815 may have one or more features in common with one or more of under-layers 115 (shown in FIG. 1) and 515 (shown in FIG. 5).

Safety surface 800 may include mat/tile 8010*a*. Safety surface 800 may include mat/tile 8010*b*. Each of mat/tile 8010*a* and mat/tile 8010*b* may have one or more features in common with one or more of mat/tiles 1010 (shown in FIG. 1), 200 (shown in FIG. 2), 300 (shown in FIG. 3), 400 (shown in FIG. 4) and 5010 (shown in FIG. 5).

Mat/tile 8010*a* and mat/tile 8010*b* may be emplaced upon under-layer 815. Mat/tile 8010*a* and mat/tile 8010*b* may be adjoined upon under-layer 815. Mat/tile 8010*a* and mat/tile 8010*b* may be joined edged to edge. Mat/tile 8010*a* may include tile edge 810. Mat/tile 8010*b* may include tile edge 806. Tile edge 810 may be adjoined to tile edge 806. Tile edge 810 may be mechanically fastened to tile edge 806 by fastener 808. Fastener 808 may be a rivet, a bolt, a screw or any other suitable fastener. Any other suitable fastener may include a peg. The peg may be integral to a tile edge, such as peg 608 (shown in FIG. 6.). Any other suitable fastener may include parts of other peg & hole arrangements integral to tile edges (not shown). Any other suitable fastener may include tongue & groove arrangements integral to tile edges (not shown).

Upper layer 818 (shown in exploded view, vertically removed from mat/tiles 8010*a* and 8010*b*) may have one or more features in common one or more of upper layers 118 (shown in FIG. 1) and 518 (shown in FIG. 5).

A bottom surface of upper layer 818 may conform to contours of an upper surface of fastener 808.

Figure 9:
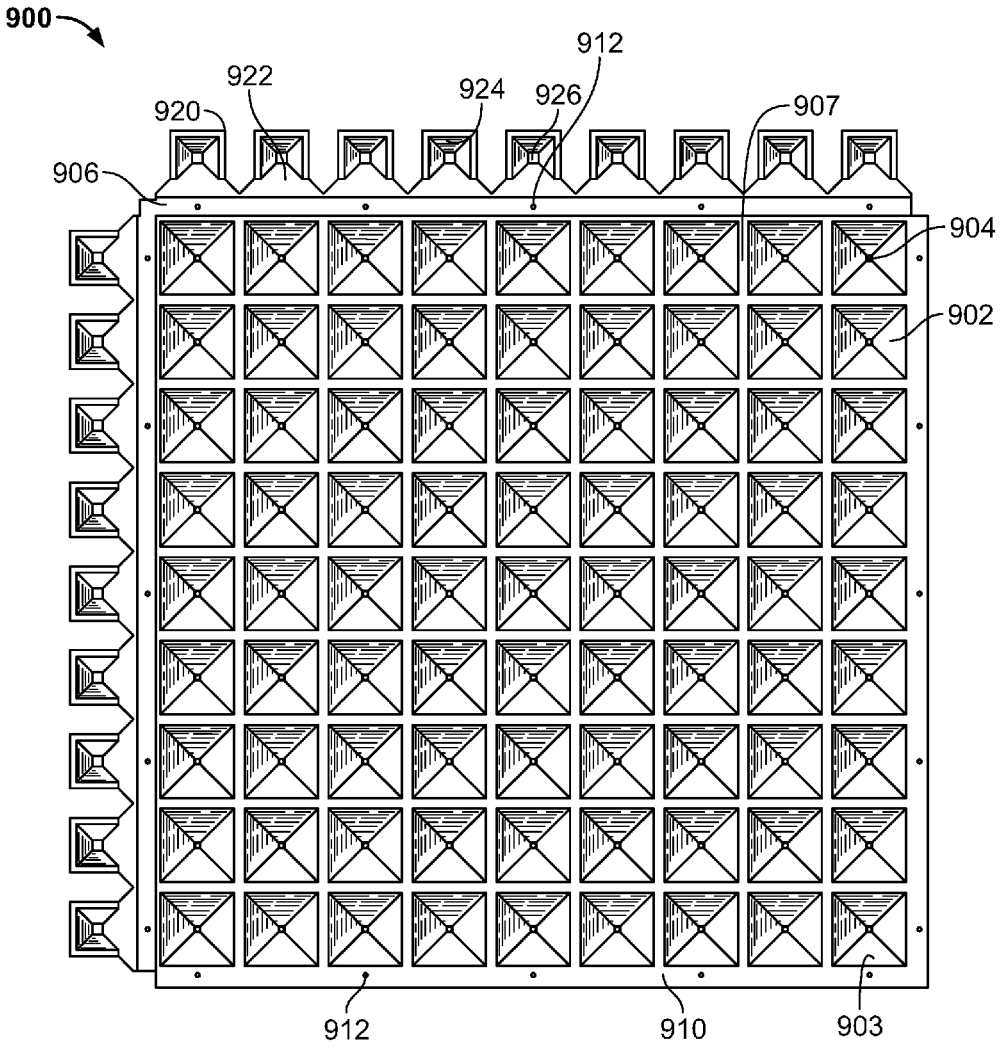
FIG. 9 is a top plan view of apparatus in accordance with principles of the invention.

FIG. 9 shows mat/tile 900. Mat/tile 900 may have one or more features in common with one or more of mat/tiles 1010 (shown in FIG. 1), 200 (shown in FIG. 2), 300 (shown in FIG. 3), 400 (shown in FIG. 4), 5010 (shown in FIG. 5) and 8010*a* and 8010*b* (shown in FIG. 8).

Mat/tile 900 may include pockets 902. Pockets 902 may include concave pocket interior surface 903. In the top plan view of FIG. 9, inner surface 903 is depicted receding downward toward a bottom of pockets 902. Pockets 902 may be shaped as hollow inverted square pyramids.

Pockets 902 may include apertures 904. Apertures 904 may be located at the bottom of pockets 902. Apertures 904 may be centered within pockets 902.

Mat/tile 900 may include tile edge 906. Tile edge 906 may border pockets 902. Tile edge 906 may border pocket rims 907. Pocket rims 907 may be part of upper perimeters of pockets 902.

Tile edge 906 may support receptacle 920. Receptacle 920 may include descending wall 922. Wall 922 may descend from tile edge 906. Tile edge 906 may support wall 922. Wall 922 may join tile edge 906 to the rest of receptacle 920.

Receptacle 920 may define receptacle interior surface 924. Contours of interior surface 924 may be geometrically complementary to exterior surfaces of pockets 902. (Such exterior surfaces, not shown in this view of mat/tile 900, may have features in common with exterior surfaces 101 (shown in FIG. 1), 401 (shown in FIG. 4) or 501 (shown in FIG. 5).

Receptacle 920 may define receptacle bottom opening 926.

Receptacle 920 may be used to effect interlocked engagement of mat/tiles by providing a "cup" into which pockets of adjoined mat/tiles (not shown) may be set.

Mat/tile 900 may include tile edge 910. Tile edge 910 may border pockets 902. Tile edge 910 may border pocket rims 907. Tile edge 910 may include holes 912. Tile edge 906 may include holes 912. Holes 912 may be used with a fastener through lined up holes of overlapping tile edges to secure interlocked mat/tiles.

Figure 10:
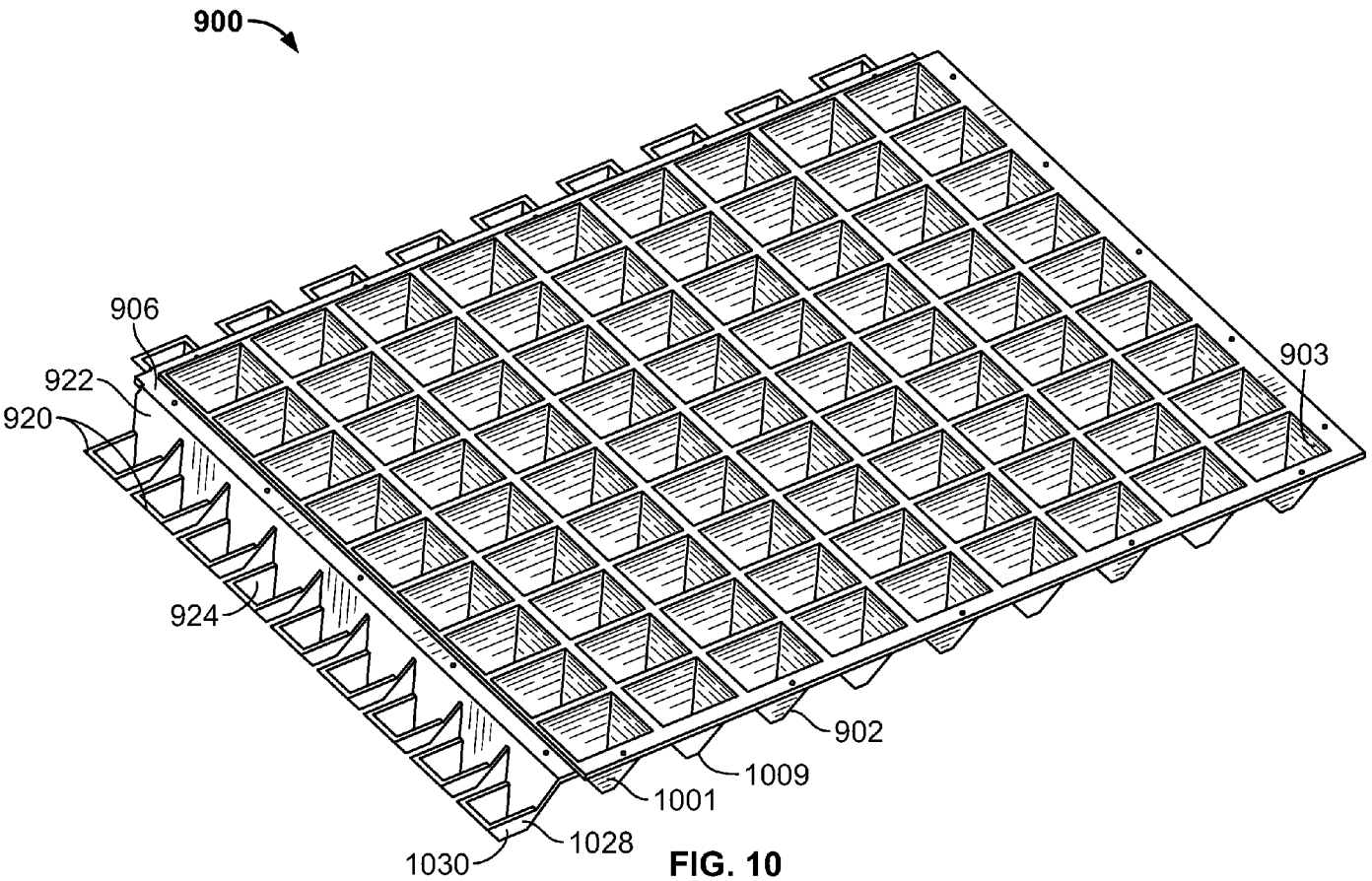
FIG. 10 is a top perspective view of apparatus in accordance with principles of the invention.

FIG. 10 shows pockets 902, pocket interior surface 903, tile edge 906, receptacles 920, wall 922 and receptacle interior surface 924. FIG. 10's perspective view of mat/tile 900 shows that mat/tile 900 may include pocket exterior surface 1001 and pocket lower extremity 1009. Pocket exterior surface may be part of an outer pocket shape that is complementary to contours of interior surface 924. Similar pockets of adjoining mat/tiles (not shown) may be received and held by receptacles 920.

Receptacle 920 may include receptacle sidewall 1028. Receptacle 920 may include receptacle lower extremity 1030. Receptacle sidewall 1028 may include receptacle lower extremity 1030.

Figure 11:
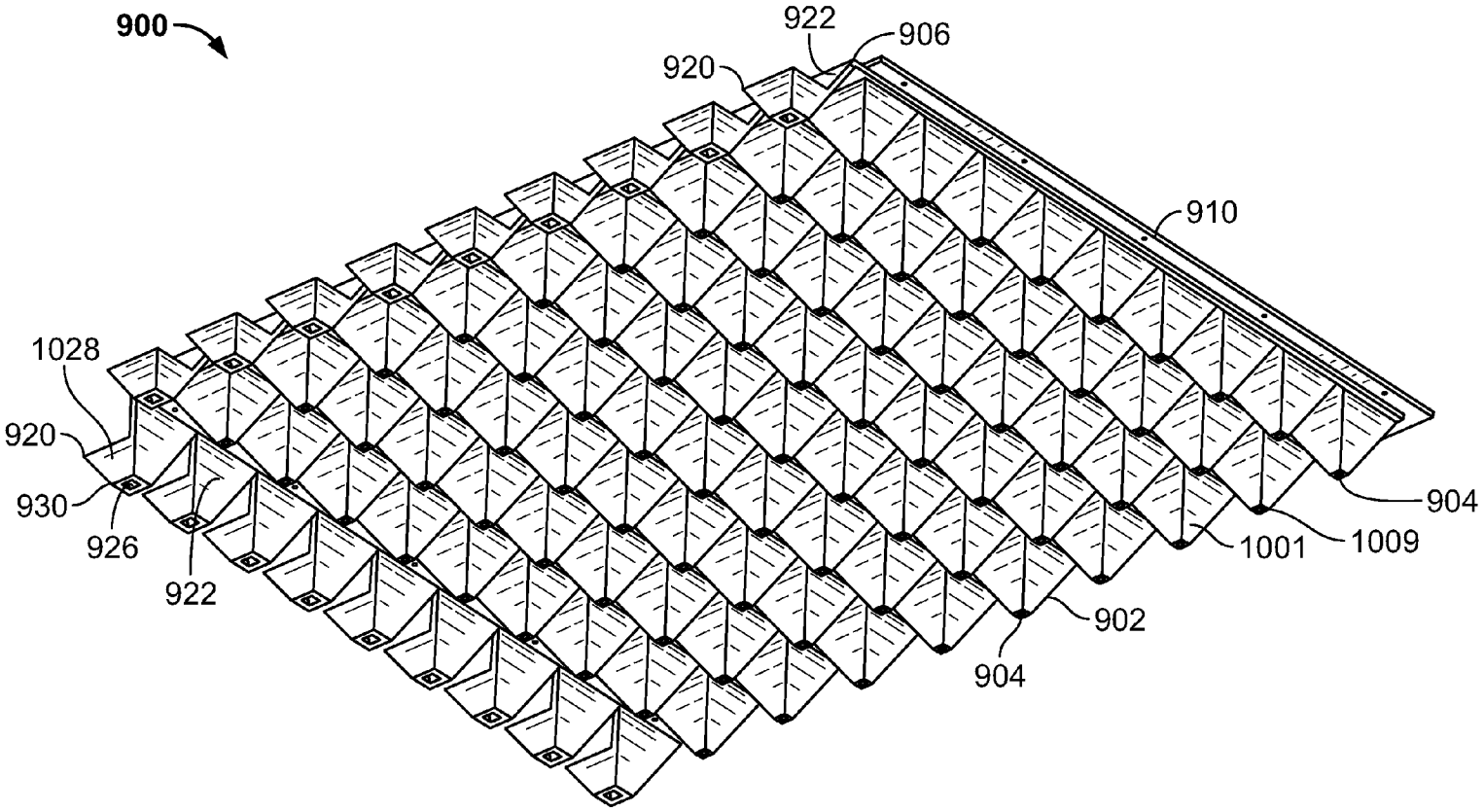
FIG. 11 is a bottom perspective view of apparatus in accordance with principles of the invention.

FIG. 11 shows pocket 902 of mat/tile 900; pocket exterior surface 1001; pocket lower extremity 1009; and aperture 904. The view of FIG. 11 shows that aperture 904 may be located at a bottom apex of pocket 902. Aperture 904 may traverse a portion of extremity 1009.

FIG. 11 shows tile edge 910; tile edge 906; wall 922 of receptacle 920 attached to, and descending from, tile edge 906; receptacle sidewall 1028; receptacle lower extremity 1030; and receptacle bottom opening 926. The view of FIG. 11 shows that opening 926 may traverse a portion of extremity 1030. Opening 926 may be dimensioned to accommodate a portion of a pocket lower extremity of another mat/tile (not shown) similar to pocket extremity 1009.

Figure 12:
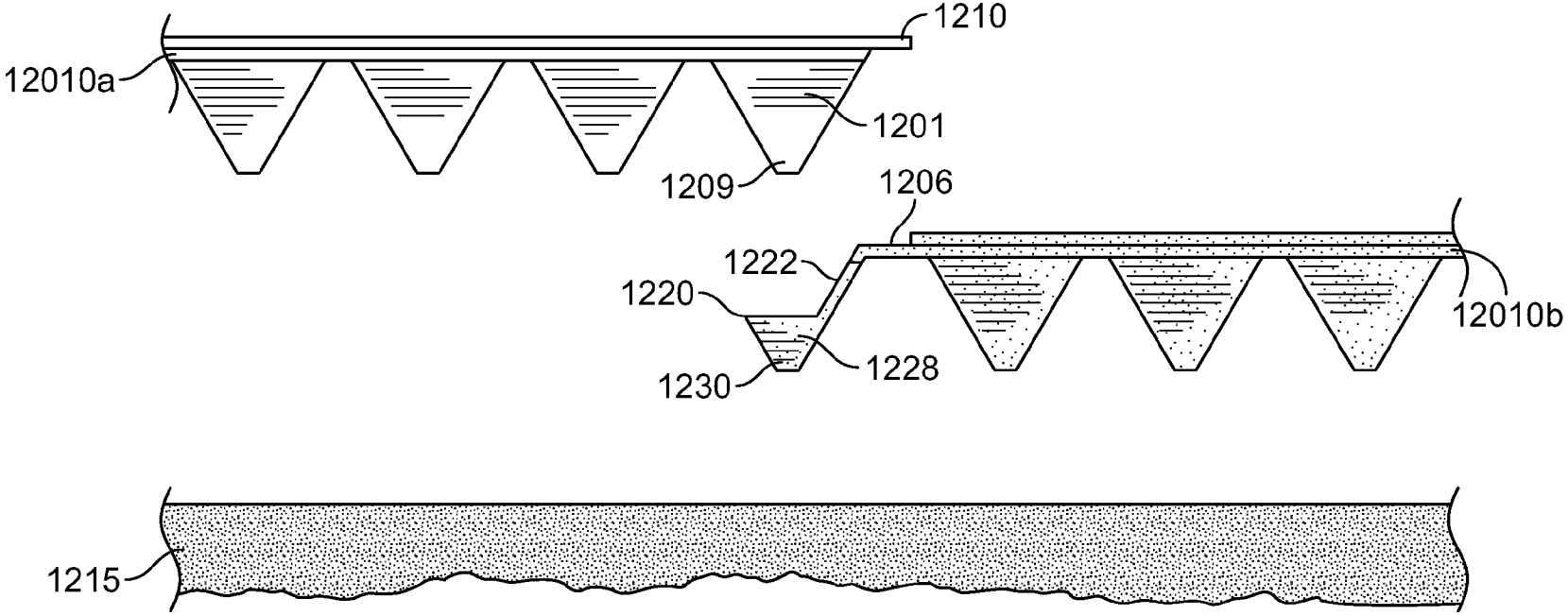
FIG. 12 is an exploded, side view of apparatus in accordance with principles of the invention, showing uncoupled apparatus components.

FIG. 12 shows mat/tile 12010*a* and mat/tile 2010*b*. Each of mat/tile 12010*a* and mat/tile 12010*b* may have one or more features in common with one or more of mat/tiles 1010 (shown in FIG. 1), 200 (shown in FIG. 2), 300 (shown in FIG. 3), 400 (shown in FIG. 4), 5010 (shown in FIG. 5), 8010*a* and 8010*b* (shown in FIG. 8) and 900 (shown in FIG. 9).

Mat/tile 12010*a* and mat/tile 12010*b* may be emplaced upon under-layer 1215 (shown in this exploded view vertically removed from mat/tiles 12010*a* and 12010*b*). Mat/tile 12010*a* and mat/tile 12010*b* may be adjoined upon under-layer 1215. Mat/tile 12010*a* and mat/tile 12010*b* may be joined edged to edge. Mat/tile 12010*a* may include tile edge 1210. Mat/tile 12010*a* may include pocket 1202. Pocket 1202 may include pocket exterior surface 1201. Pocket exterior surface 1201 may include lower extremity 1209.

Mat/tile 12010*b* may include tile edge 1206 which may support wall 1222 of receptacle 1220. Receptacle 1220 may include sidewall 1228. Receptacle 1220 may include lower extremity 1230.

Pocket exterior surface 1201 may be complementary to an interior contour (shown) of receptacle 1220. Receptacle 1220 may receive pocket 1202. A portion of pocket 1202 may fit within receptacle 1220. Extremity 1209 may fit within receptacle 1220. An interior portion (not shown) of extremity 1230 may accommodate extremity 1209. When extremity 1209 is set within the interior portion of extremity 1230, a bottom-most surface of pocket 1202 of mat/tile 12010*a* may be substantially coplanar with a bottom-most surface of mat/tile 12010*b*.

FIG. 12 depicts mat/tile 12010*a* and mat/tile 12010*b* vertically removed from each other, illustrating an uncoupled configuration of the mat/tiles.

Figure 13:
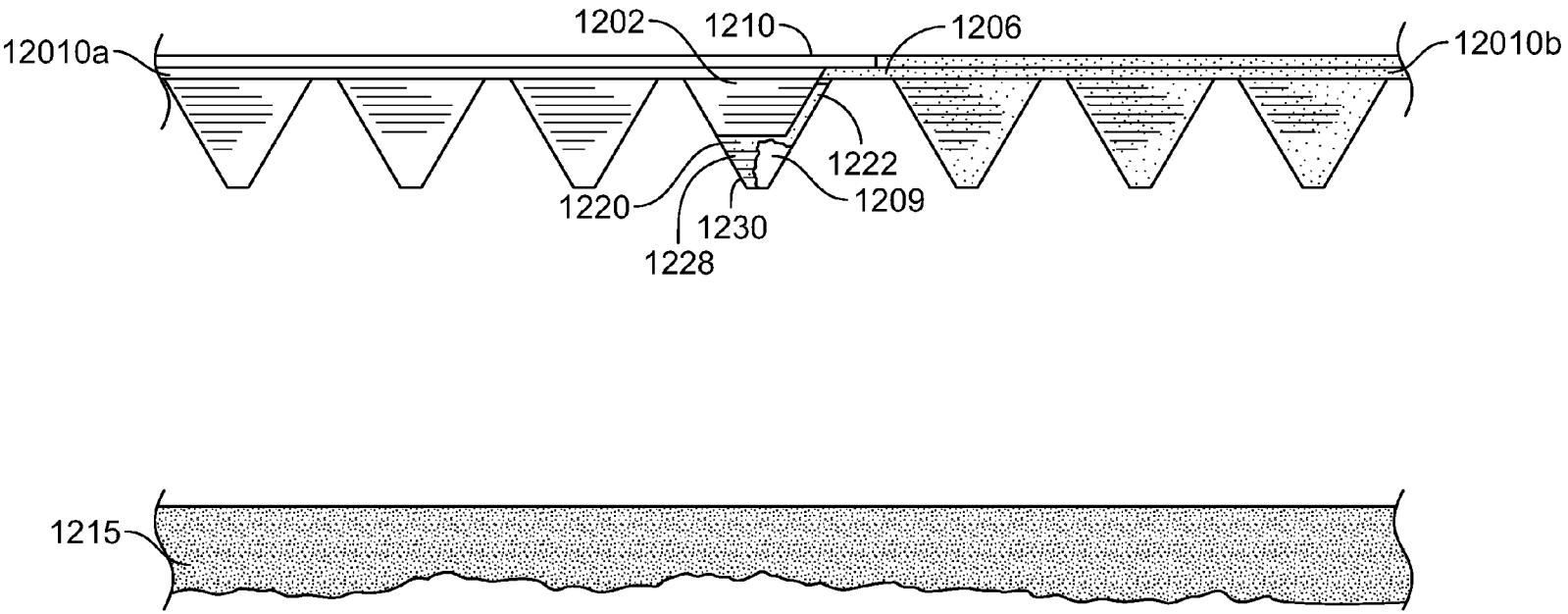
FIG. 13 is an exploded, side view of apparatus in accordance with principles of the invention, showing coupled apparatus components, including a cutaway of external features providing a view of internal features of the apparatus.

FIG. 13 depicts pocket 1202 of mat/tile 12010*a* set into receptacle 1220 of mat/tile 12010*b*, illustrating an coupled configuration of the mat/tiles. Mat/tile 12010*a* and mat/tile 12010*b* may be disposed upon under-layer 1215 in the coupled configuration.

As shown in cutaway of a bottom corner of sidewall 1228, extremity 1209 nested within extremity 1230 may be substantially coplanar with the bottom-most surface of mat/tile 12010*b*. Adjacent to receptacle-set pocket 1202 of mat/tile 12010*a*, tile edge 1210 of mat/tile 12010*a* may overlie tile edge 1206 of mat/tile 12010*b*.

Figure 14:
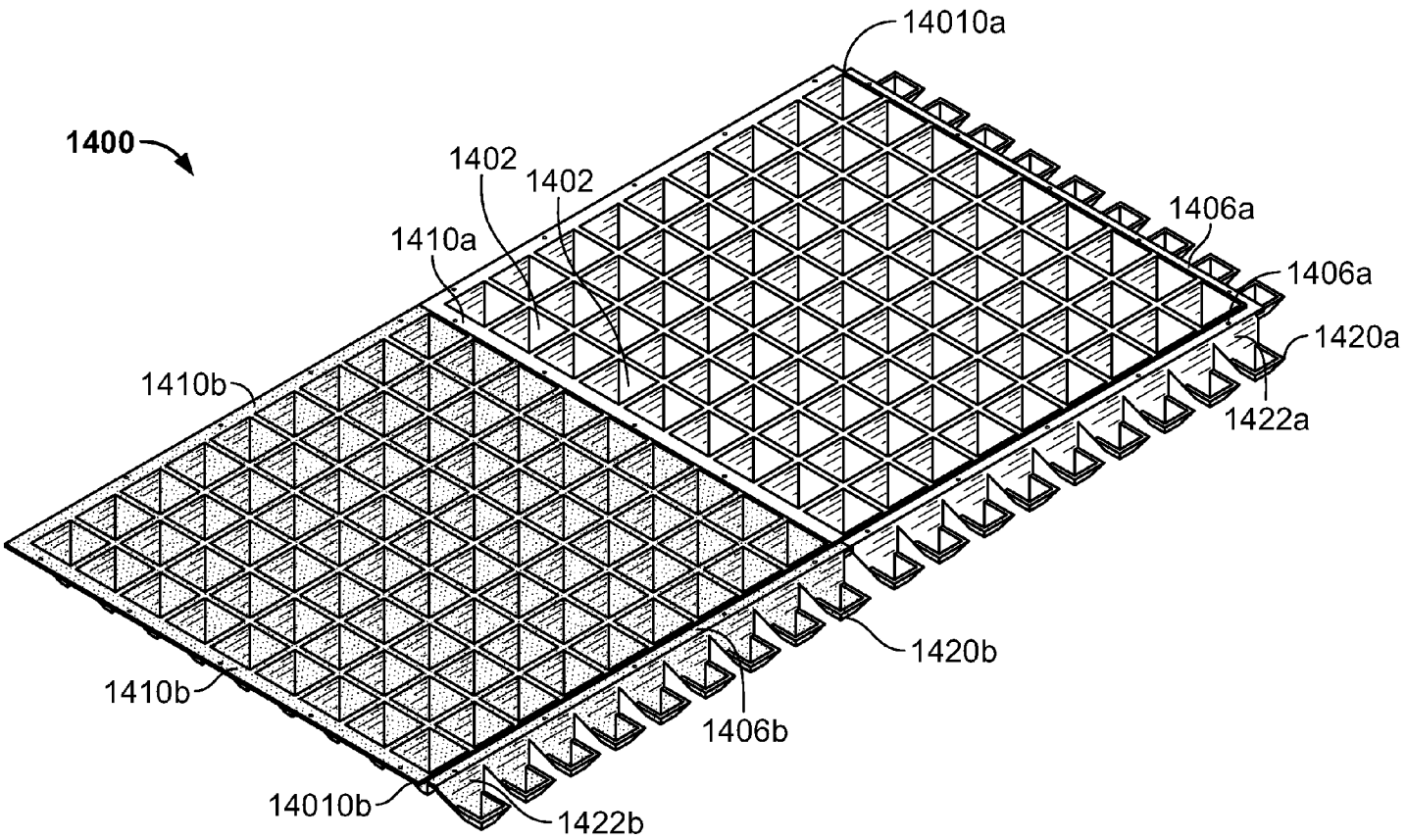
FIG. 14 is a perspective top view of apparatus in accordance with principles of the invention, showing coupled apparatus components.

FIG. 14 shows coupled configuration 1400. Configuration 1400 may include mat/tile 14010*a* and mat/tile 14010*b*. Each of mat/tile 14010*a* and mat/tile 14010*b* may have one or more features in common with one or more of mat/tiles 1010 (shown in FIG. 1), 200 (shown in FIG. 2), 300 (shown in FIG. 3), 400 (shown in FIG. 4), 5010 (shown in FIG. 5), 8010*a* and 8010*b* (shown in FIG. 8), 900 (shown in FIG. 9) and 12010*a* and 2010*b* (shown in FIG. 12). The coupling of mat/tile 14010*a* and mat/tile 14010*b* may share one or more features with the coupling of mat/tile 12010*a* and mat/tile 2010*b* illustrated in FIG. 13.

Mat/tile 14010*a* may include tile edge 1406*a*. Tile edge 1406*a* may support receptacles 1420*a*. Descending wall 1422*a* may attach tile edge 1406*a* and receptacle 1420*a*. Mat/tile 14010*a* may feature a row of receptacles 1420*a* along each tile edge 1406*a*. Multiple tile edges 1406*a* may be adjacent one another.

Mat/tile 14010*b* may include tile edge 1406*b*. Tile edge 1406*b* may support receptacles 1420*b*. Descending wall 1422*b* may attach tile edge 1406*b* and receptacle 1420*b*.

Mat/tile 14010*b* may feature a row of receptacles 1420*b* along each tile edge 1406*b*. Multiple tile edges 1406*b* may be adjacent one another. A second tile edge 1406*b* (not shown) may lie below, and be covered by, the tile edge 1410*a* shown adjoining mat/tile 14010*b*. A second row of receptacles 1420*b* (not shown) may be supported by the covered second tile edge 1406*b*. Receptacles 1420*b* of the second row of receptacles 1420*b* may receive pockets 1402 of mat/tile 14010*a*. Pockets 1402 may be set into the receptacles 1420*b* supported by the covered edge 1406*b*. In the coupled configuration shown, tile edges 1410*a* and tile edges 1410*b* may be coplanar.

Figure 15:
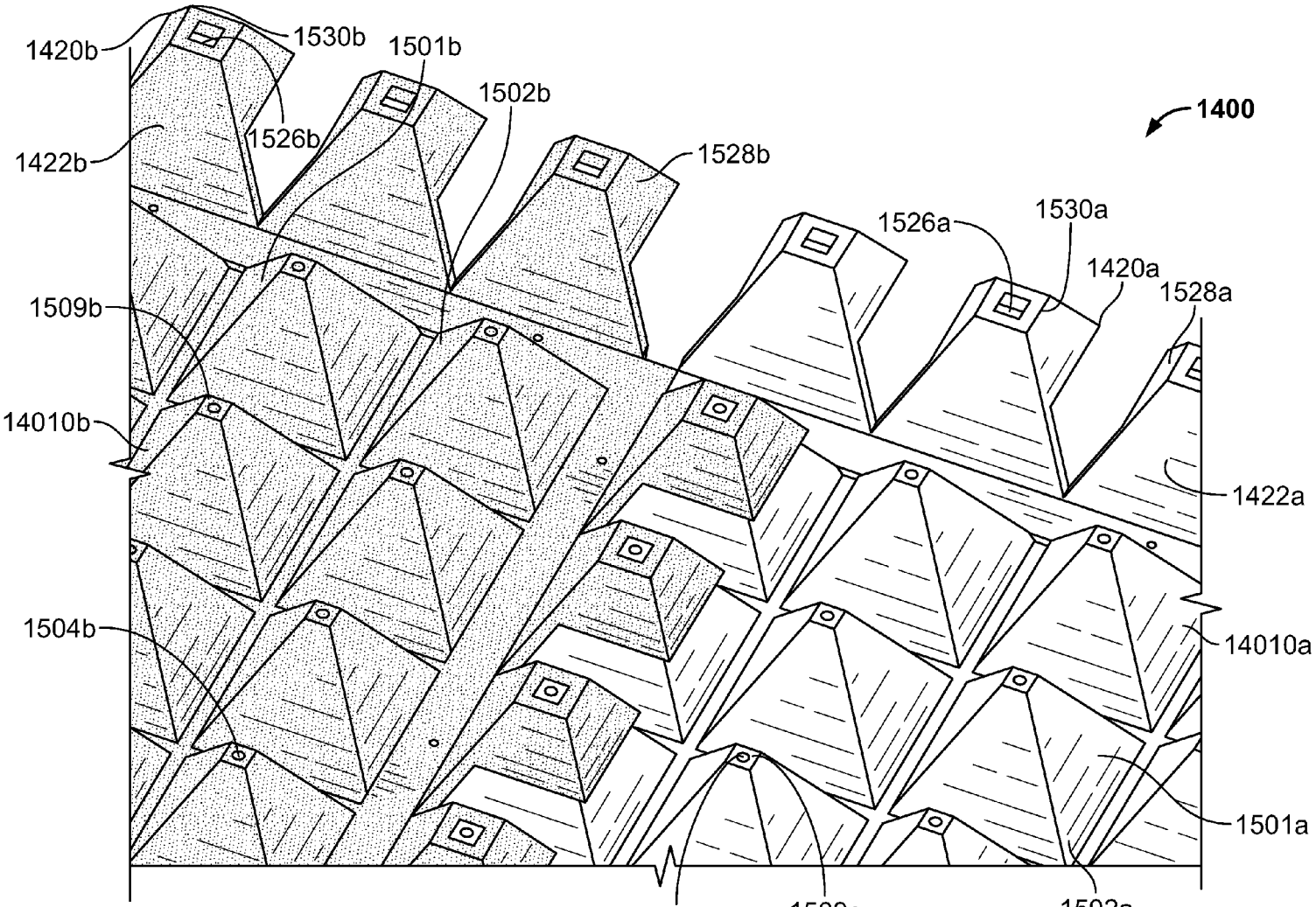
FIG. 15 is a perspective bottom view of apparatus in accordance with principles of the invention, showing coupled apparatus components.

FIG. 15 shows details of coupled configuration 1400 in a bottom view, showing mat/tile 14010*a*, with receptacle 1420*a* and wall 1422*a*, and mat/tile 14010*b*, with receptacle 1420*b* and wall 1422*b*.

Mat/tile 14010*a* may include pockets 1502*a*. Pockets 1502*a* may include pocket exterior surface 1501*a*. Pocket exterior surface 1501*a* may include lower pocket extremity 1509*a*. Aperture 1504*a* may traverse a bottom-most face of extremity 1509*a*.

Receptacles 1420*a* may include receptacle sidewalls 1528*a*. Receptacle 1420*a* may include receptacle lower extremity 1530*a*. Receptacle 1420*a* may define receptacle bottom opening 1526*a*.

Mat/tile 14010*b* may include pockets 1502*b*. Pockets 1502*b* may include pocket exterior surface 1501*b*. Pocket exterior surface 1501*b* may include lower pocket extremity 1509*b*. Aperture 1504*b* may traverse a bottom-most face of extremity 1509*b*.

Receptacles 1420*b* may include receptacle sidewalls 1528*b*. Receptacle 1420*b* may include receptacle lower extremity 1530*b*. Receptacle 1420*b* may define receptacle bottom opening 1526*b*.

In the coupled configuration shown, pocket 1502*a* may be set in receptacle 1420*b*. A row of pockets 1502*a* may be set in a row of receptacles 1420*b*. The bottom-most face of extremity 1509*a* of receptacle-set pocket(s) 1502*a* may be accommodated dimensionally by bottom opening(s) 1526*b*.

Figure 16:
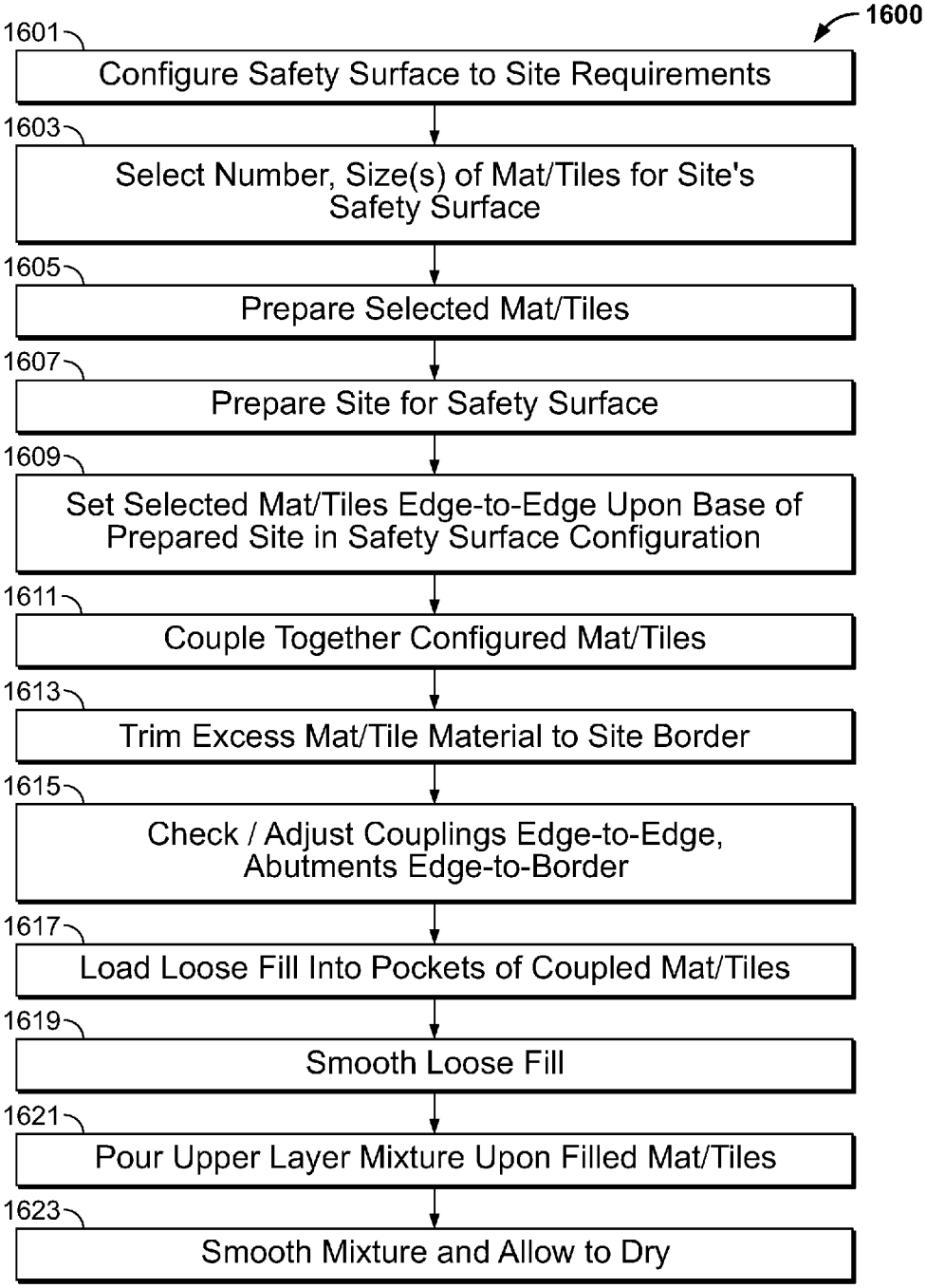
FIG. 16 is a flow diagram of an illustrative process in accordance with the principles of the invention.

FIG. 16 shows illustrative steps of process 1600 for on-site installation of a safety surface. The process may begin at step 1601.

At step 1601, the installer may configure a planned rubber-mat-based safety surface to requirements of the playground. The planned rubber-mat-based poured-in-place safety surface may constitue an ADA-compliant unitary safety surface. The requirements of the playground may include specifics as to an area, a shape of the area and locations along a periphery of the area that the safety surface is to underlie. Specifics as to the area, the shape of the area and/or locations along the periphery of the area may typically include information about routes of access to the playground. Requirements of the playground may include specifics as to locations and types of existing and/or planned playground equipment. Requirements of the playground may include any other suitable specifics. Other suitable specifics may include surface and subsurface considerations, such as colors of equipment and/or of surrounding terrain, and such as locations of underground utilities. Other suitable specifics may include playground traffic projections, including user-age demographics. Other suitable specifics may include a projected lifetime of the playground. Other suitable specifics may include budgetary considerations.

Configuring the planned safety surface may be carried out by assessment of the requirements. Assessments may be done remotely and/or on site. Assessments may include determination of under-layer depth, composition of loose fill material, mat/tile height and upper layer height.

Configuring may be carried out virtually on paper, via computer and/or by other suitable means. Configuring may be carried out physically, as in laying out upon the area all or some of proposed components of the planned safety surface.

Configuring the planned safety surface may be an iterative process. Successful configuring the planned safety surface may be followed by step 1603.

At step 1603, the installer may select the number, size(s) and shape(s) of mat/tiles to be used in the mat/tile layer of the planned safety surface. Size(s) may include mat/tile "footprint" size(s), mat/tile height(s) and pocket upper perimeter(s). Shape(s) may include mat/tile "footprint" shape(s), pocket outer shape(s) and pocket perimeter shape(s).

The installer may, similarly, select number, size(s) and shape(s) of other structural elements. The installer may also select other features of components of the planned safety surface, such as tile edge type (e.g., peg & hole arrangement; tongue and groove arrangement; bearing pocket-receiving receptacle(s)), fasteners, color(s), variety of border alert markers, types of loose fill, and composition of upper layer-forming mixture.

At step 1605, the installer may prepare the selected structural elements, such as mat/tiles. Preparation may involve inspection of the selected structural elements. Inspection may include checking for blockages of pocket apertures or of tile edge holes (which may include receptacle openings). Preparation may involve removal of blockages of pocket apertures or of tile edge holes.

At step 1607, the installer may prepare the site for installation of the planned safety surface. The installer may set border rails along the periphery of the playground or a portion of the periphery of the playground.

The installer may excavate the area to several inches below a desired depth of the safety surface. The installer may fill the area, to a height corresponding to those several inches, with under-layer material, such as concrete and/or crushed stone. The installer may level the under-layer. For a playground with a pre-existing under-layer, the installer may check and adjust the existing under-layer's properties, such as drainage capabilities and levelness. Any fill regions of the under-layer may be overspread with loose fill.

At step 1609, the installer may set the selected structural elements, such as the selected mat/tiles, upon the under-layer, engaging any loose fill beneath the mat/tiles. The structural elements may be set adjoining each other in the configuration of the planned safety surface. Adjoining mat/tiles may be set tile edge to tile edge. Tile edges of peg & hole, tongue & groove or pocket-receiving receptacle arrangements, or of other arrangements of complementarily interlocking mat/tile peripheries, may be set overlapping.

The structural elements may be modified to accommodate existing or planned playground equipment (e.g., a circular section may be cut out of a corner of a mat/tile to accommodate a support pole of a swing set). The structural elements may be leveled. The installer may adjust structural elements relative to each other upon the under-layer to achieve a final configuration ready for structural engagement.

At step 1611, the installer may engage the structural elements, such as mat/tiles, configured together upon the under-layer. The installer may mechanically couple together the structural elements. Mat/tiles may be mechanically engaged to each other by hardware fasteners and/or by coupling of complementarily interlocking mat/tile peripheries. (With some arrangements of complementarily interlocking mat/tile peripheries, step 1611 may be substantially completed for mat/tile-to-mat/tile coupling in step 1609.) Mat/tiles may be mechanically engaged to support ribs. Mat/tiles may be mechanically engaged to border rails. Support ribs may be mechanically engaged to each other. Support ribs may be mechanically engaged to border rails. Anchors may be set in place. Setting anchors in place may stabilize structural elements of the safety surface.

At step 1613, the installer may adjust mat/tiles to optimally adjoin a border of the site (a "site border"). The installer may trim away excess mat/tile "footprint" to produce an adjusted tile edge. The adjusted tile edge may optimally adjoin the site border.

The site border may be part of an access route to the playground. At such site borders, the installer may particular focus on several factors to produce smooth transition to the access route. The factors may include height of mat/tiles adjoining the site border relative to the planned height of the poured-in-place upper layer; closeness of complementarity and engagement of mat/tiles to the site border; and mechanical security of engagement of mat/tiles to the site border.

At step 1615, the installer may perform a final set of inspections (and, if need be, iterative adjustments and checks) of mechanical engagements of structural elements of the safety surface. Mechanical engagements to be inspected may include couplings and/or fastenings of tile edges to tile edges and abutments of tile edges to border rails. Other mechanical engagements to be inspected may include interlocking of tile edges with support ribs, settings of anchors in their positions, and engagement of mat/tiles to access route site borders.

At step 1617, the installer may load loose fill into pockets of the fastened mat/tiles. The installer may fill the pockets with loose fill. The mat/tile layer may now be complete.

At step 1619, the installer may smooth and/or level the loose fill overlying the mat/tiles, exposing upper surfaces of pocket rims and tile edges for bonding to the subsequent overlaid upper layer mixture. The mat/tile layer may now be ready for the emplacement of the upper layer.

At step 1621, the installer may pour-in-place the upper layer by overspreading the mat/tile layer with one or more layerings of the upper layer mixture. The mixture may be poured to the desired height above the mat/tile layer.

At step 1623, the installer may smooth and/or level the mixture overlying the mat/tile layer. The installer may imprint a texture upon an upper surface of the mixture. The installer may allow the mixture to dry to form the upper layer of the safety surface.

In some embodiments, steps 1621 and 1623 may be combined as an emplacing of one, or more than one, ready-made upper layer component(s) upon the mat/tile layer. The ready-made upper layer component(s) may include a surface tiling. The ready-made upper layer component(s) may include a flooring surface. The ready-made upper layer component(s) may include a rolled-out mat-surfacing. The ready-made upper layer component(s) may include rubber sheeting. The ready-made upper layer component(s) may include synthetic turf. The ready-made upper layer component(s) may include foam-backed turf. The installer may adjoin the edges of the ready-made upper layer components. The installer may engage the edges of the ready-made upper layer components. The installer may mechanically fasten together the ready-made upper layer components.

The upper layer of the safety surface may be a unitary upper surface.

The installer may thus complete the installation.

Thus, apparatus and methods for safety surfaces with engineered shock-absorbing bases of consistently high impact attenuation performance have been provided. Persons skilled in the art will appreciate that the present invention can be practiced by other than the described embodiments, which are presented for purposes of illustration rather than of limitation. The present invention is limited only by the claims that follow.

What is claimed is:

1. A safety surface for emplacement upon an under-layer, said safety surface comprising:

a tile including a plurality of empty pockets, each of the pockets having at least one pocket upper edge, a lower outer surface of at least one of the pockets for engaging at least a part of the under-layer and an inner surface of each of the pockets for receiving loose fill, at least some of the pockets further having at least one aperture for allowing passage of fluid therethrough;

the loose fill received within at least one of the pockets; and an upper layer of resilient material emplaced on the tile.

2. The safety surface of claim 1, wherein the under-layer includes a mineral aggregate.

3. The safety surface of claim 1, wherein the under-layer includes concrete.

4. The safety surface of claim 1, wherein the at least one pocket upper edge comprises at least a part of a pocket upper perimeter.

5. The safety surface of claim 4, wherein at least part of the outer surface comprises at least part of a pocket outer shape.

6. The safety surface of claim 5, wherein the pocket outer shape comprises at least one extremity at a maximal depth distance from the pocket upper edge.

7. The safety surface of claim 6, wherein a perimeter of the pocket outer shape proximal to the extremity and substantially parallel to the pocket upper perimeter is smaller than the pocket upper perimeter.

8. The safety surface of claim 1, wherein the resilient material includes a surface affixed to the tile.

9. The safety surface of claim 8, wherein the surface is affixed by an adhesive.

10. The safety surface of claim 1, wherein the resilient material is poured-in-place upon the tile.

11. The safety surface of claim 10, wherein the upper layer seals the loose fill within the at least one pocket.

12. The safety surface of claim 1, wherein the resilient material is emplaced upon a layer of material between the tile and the upper layer.

13. The safety surface of claim 1, wherein the resilient material is rolled out upon the tile.

14. The safety surface of claim 1, wherein the resilient material is emplaced upon the loose fill.

15. The safety surface of claim 1, wherein the resilient material is poured-in-place upon the loose fill.

16. The safety surface of claim 1, wherein the upper layer seals the at least one pocket upper edge.

17. The safety surface of claim 1, wherein the at least one aperture is insufficiently wide to allow passage of loose fill therethrough.

18. A safety surface for wheelchair accessibility and an environment of the safety surface, said environment and safety surface comprising:

an under-layer including a material selected from the group consisting of packed earth, mineral aggregate, crushed stone, wood flooring and concrete;

at least two tiles emplaced upon the under-layer, each tile including:

a plurality of empty pockets, each of the pockets having a rim, a lower outer surface of at least one of the pockets for engaging at least a part of the under-layer and an inner surface of each of the pockets for receiving loose fill, at least some of the pockets further having at least one aperture for allowing passage of fluid therethrough; and a plurality of tile edges, said plurality of tile edges bordering the plurality of empty pockets, at least one of the plurality of tile edges for engaging a structural element of the safety surface;

the loose fill received within at least one of the pockets; and an upper layer of resilient material emplaced upon the tiles, the upper layer overlaying the loose fill and sealing at least a portion of one rim.

19. The safety surface of claim 18, wherein each of the pockets is proximal, along the rim, to at least one other of the pockets.

20. The safety surface of claim 18, wherein the structural element comprises a safety surface structural element selected from the group consisting of tiles, anchors, support ribs, border rails and border alert markers.

21. The safety surface of claim 20, wherein the at least one of the plurality of tile edges of a first of the tiles includes a structure configured to hold one of the plurality of pockets of a second of the tiles, cupping a bottom extremity of the one of the plurality of pockets from below.

22. The safety surface of claim 18, wherein the upper layer comprises a surface of resilient material selected from the group consisting of poured-in-place material, rolled-out material, synthetic turf and dimensioned floor tiling material.

23. A method for manufacturing, on site, a safety surface for wheelchair accessibility, the method comprising:

emplacing, upon an under-layer of the site, at least one tile having a plurality of empty pockets, each of the pockets having:

an exterior surface, at least part of which contacts at least a part of the under-layer;

an interior surface for receiving resilient loose fill material;

an aperture for allowing passage of fluid from the interior surface to the under-layer; and a rim;

placing the loose fill material into at least one of the pockets;

spreading over the emplaced tile a mixture of resilient particles and binder, the mixture poured-in-place upon the tile; and allowing the mixture to dry, whereby the dried mixture in combination with the tile and loose fill forms the safety surface.

24. The method of claim 23 wherein the placing includes filling the at least one pocket with loose fill material.

25. The method of claim 23, further comprising, prior to the spreading, contouring an upper surface of the loose fill material in the at least one pocket such that the upper surface is substantially level with the rim.

26. The method of claim 23 wherein the spreading includes covering the loose fill material.

27. The method of claim 23 wherein the mixture seals at least one rim.

28. The method of claim 23 wherein the at least one tile is a first tile, the method further comprising:

emplacing upon the under-layer a second tile; and engaging the first tile with the second tile, wherein the engaging includes cupping from below at least one of the plurality of pockets of the first tile.

29. The method of claim 28 wherein:

the second tile comprises at least one receptacle having an interior contour structurally complementary to at least part of the exterior surface of the one of the plurality of pockets of the first tile, the receptacle configured to receive the at least part of the exterior surface, the at least part of the exterior surface including a bottom extremity of the one of the plurality of pockets; and the engaging comprises setting the exterior surface into the receptacle.

30. The method of claim 29 wherein the at least part of the exterior surface set into the receptacle contacts the interior contour.

31. The method of claim 29 wherein the receptacle limits movement of the exterior surface set into the receptacle.

32. The method of claim 29 wherein:

the receptacle is attached to the rest of the second tile along an edge of the second tile; and the one of the plurality of pockets of the first tile lies along an edge of the first tile.

33. A safety surface for wheelchair accessibility, said safety surface comprising:

at least two resilient tiles emplaced upon an under-layer, each tile including:

a plurality of empty pockets, each of the pockets having a rim, an inner surface of the pockets for receiving loose fill and a lower portion of an outer surface of at least one of the pockets for engaging at least a part of the under-layer; and a plurality of tile edges bordering the plurality of empty pockets, at least one of the plurality of tile edges of a first of the tiles supporting a structure contoured interiorly complementary to at least part of the outer surface of one of the pockets of a second of the tiles, the at least part of the exterior surface including a bottom extremity of the one of the plurality of pockets of the second tile, such that coupling the one of the pockets with the structure limits relative movement of the first and second tiles and maintains the rims of the second tile at substantially the same height above the under-layer as the height above the under-layer of the rims of the first tile.

34. The safety surface of claim 33 wherein at least some of the pockets further have at least one aperture for allowing passage of fluid from the inner surface to the under-layer.

35. The safety surface of claim 33 further comprising the loose fill received within at least one of the pockets.

36. The safety surface of claim 33 further comprising an upper layer of resilient material emplaced upon the tiles, the upper layer sealing at least a portion of one rim.

37. The safety surface of claim 36 wherein the upper layer overlays the loose fill received within at least one of the pockets.

38. The safety surface of claim 36, wherein the resilient material is selected from the group consisting of poured-in-place material, rolled-out material, synthetic turf and dimensioned floor tiling material.

39. A safety surface comprising:

at least two resilient tiles emplaced upon an under-layer, each tile including:

a plurality of empty pockets, each of the pockets having a rim and at least one of the pockets having at least one aperture for allowing passage of fluid therethrough from an interior of the pocket to the under-layer, a portion of an outer surface of at least one of the pockets for engaging at least a part of the under-layer; and a plurality of tile edges bordering the plurality of empty pockets; and an upper layer of resilient material emplaced upon the tiles, the upper layer bonding with upper surfaces of the tiles;

wherein a first tile edge of a first of the tiles adjoins a second tile edge of a second of the tiles, and one of the first tile edge and the second tile edge underlies the other of the first tile edge and the second tile edge, the upper layer bonding to the other of the first tile edge and the second tile edge, the upper layer extending from the adjoined first and second edges toward a first pocket of the first tile and toward a second pocket of the second tile and sealing at least a portion of one rim of each of the first and second pockets.

40. The safety surface of claim 39 further comprising loose fill received within the interior of at least one of the pockets of each tile, the upper layer sealing the loose fill within the at least one of the pockets of each tile.

41. The safety surface of claim 39 wherein at least one of the plurality of tile edges of the first tile supports a structure contoured interiorly complementary to at least part of the outer surface of one of the pockets of the second tile, the at least part of the exterior surface including a bottom extremity of the one of the plurality of pockets of the second tile, such that coupling the one of the pockets of the second tile with the structure limits relative movement of the first and second tiles and maintains the rims of the second tile at substantially the same height above the under-layer as the height above the under-layer of the rims of the first tile.

* * * * *